US005107739A

United States Patent [19]

Muramatsu et al.

[11] Patent Number: 5,107,739

[45] Date of Patent: Apr. 28, 1992

[54] KEY ACTUATING DEVICE OF AN AUTOMATIC PLAYING KEYBOARD INSTRUMENT

[75] Inventors: Shigeru Muramatsu; Tsutomu Sasaki, both of Hamamatsu, Japan

[73] Assignee: Yamaha Corporation, Hamamatsu, Japan

[21] Appl. No.: 617,899

[22] Filed: Nov. 26, 1990

[30] Foreign Application Priority Data

Nov. 28, 1989 [JP] Japan ..... 1-308528
Nov. 28, 1989 [JP] Japan ..... 1-308529
Nov. 30, 1989 [JP] Japan ..... 1-311077

[51] Int. Cl.[5] ..... G10F 1/02
[52] U.S. Cl. ..... 84/20
[58] Field of Search ..... 84/18, 19, 20, 21, 22, 84/107, 246

[56] References Cited

FOREIGN PATENT DOCUMENTS 1-217398 8/1989 Japan ..... 84/20

*Primary Examiner*—L. T. Hix
*Assistant Examiner*—Howard B. Blankenship
*Attorney, Agent, or Firm*—Spensley Horn Jubas & Lubitz

[57] ABSTRACT

A key actuating device of an automatic playing keyboard instrument has a plurality of key actuator units each of which is provided for each of keys arranged above a key bed of a keyboard instrument, preferably between a balance rail and a front rail, and includes a coil or coils provided above the upper surface of the key bed for producing a magnetic field corresponding to a current supplied from outside and passing therethrough in a direction substantially normal to a rocking direction of the key, a plunger fixedly provided on the lower surface of the key, and a yoke or yokes provided fixedly on the coil or coils and opposing the plunger. A relative area of portions of the yoke and the plunger opposing each other or an interval between these portions is variable in the rocking direction of the key and the plunger is not in contact with the coil or or the yoke at any position of the plunger in the rocking movement of the key. Since there is no mechanical contact between the plunger and the coil or yoke, noise is hardly generated in key actuating operation and damage or wear of the plunger and key can be prevented.

25 Claims, 17 Drawing Sheets

KEY ACTUATING DEVICE OF AN AUTOMATIC PLAYING KEYBOARD INSTRUMENT

BACKGROUND OF THE INVENTION

This invention relates to a key actuating device of an automatic playing keyboard instrument such as an automatic player piano and, more particularly, to a key actuating device of such instrument capable of improving the accuracy of a key depression and release control and reducing noise occurring in actuation of keys of the automatic keyboard instrument.

In an automatic playing keyboard instrument such as an automatic player piano is incorporated a key actuating device for making an automatic performance on the basis of prerecorded performance information or performance information supplied from outside.

FIG. 20 shows an example of a prior art key actuating device incorporated in an automatic player piano. In the figure, an automatic player piano 71 has a keyboard including white keys 73 and black keys 74, a string striking mechanism 77 transmitting the movement of each key 73 or 74 to a hammer 75, a string 79 struck by the hammer 75 and a damper 78 for restraining vibration of the string 79.

A key bed 84 is provided under the white keys 73 and the black keys 74. A balance rail 80 and a front rail 82 are fixedly provided on the upper surface of the key bed 84. The keys 73 and 74 are rockably supported on a balance pin 81 provided on the upper surface of the balance rail 80. An oval key pin 85 fixed on the lower surface of a front end portion of the key 73 or 74 projects downwardly from the lower surface of the key 73 or 74 toward the front rail 82 and is engaged in a depression 82*a* formed in the upper portion of the front rail 82. An undesired transverse movement of the keys 73 and 74 can be prevented by this arrangement. A push-type solenoid 83 is provided on the upper surface of the key bed 84 rearwardly of the balance rail 80 in the longitudinal direction of the key 73 or 74 and beneath the key 73 or 74. Upon actuation of the solenoid 83, a plunger 83*a* of the solenoid 83 projects upwardly and pushes up the key 73 or 74 in a portion below a wippen 86 thereby to pivot the key 73 or 74 downwardly about the balance pin 81. This movement of the key is transmitted to the hammer 75 and the damper 78 through the string striking mechanism 77. The damper 78 thereby is released from the string 79 and the hammer 75 simultaneously is pivoted counterclockwise as viewed in the figure to strike the string 79. This action is continuously made in response to output signals from a control unit 90 and an automatic performance thereby is performed.

A key holding member 87 is provided for holding the key 73 or 74 at a position above the balance pin 81 against an upward movement of the key 73 or 74 when the middle portion of the key 73 or 74 is subjected to an upwardly acting force excerted by the solonoid 83.

The prior art key actuating device of an automatic playing keyboard instrument has the following disadvantages:

1. Noise is generated when the plunger 83*a* moves in a sliding movement by actuation of the solenoid 83, when the foremost end portion of the plunger 83*a* abuts against the lower surface of the key 73 or 74, and when the plunger 83*a* returns to its final sliding stroke position.
2. The sliding movement of the plunger 83*a* and the abutment of the plunger 83*a* against the lower surface of the key 73 or 74 tend to cause damage or wear of the plunger 83*a* itself and the lower surface of the key 73 or 74 with resulting loss or reduction in reliability and durability of the key actuating device.
3. Since the key 73 or 74 is actuated by pushing it in the portion below the wippen 86, the point at which the key actuating force is applied differs from the case where a pianist plays the piano and this makes it difficult to reproduce a sound with a high fidelity.
4. It is difficult to reproduce a fine performance technique depending upon the pianist's hands by a so-called impact actuation system according to which the foremost end portion of the plunger 83*a* is caused to abut against the lower surface of the key 73 or 74. It is therefore impossible by the prior art device to reproduce a half-key technique in which a lower half portion of a key is used with a stroke of less than about 5 mm, or to reproduce a performance by rapid, repeated striking of the same key.
5. It is difficult in the impact actuation system to perform a feedback control by introducing, for example, a servo system and, therefore, improvement of the accuracy of control is limited.
6. If the position of the key holding member 87 which is required for holding the key 73 or 74 against an upward movement caused by pushing by the plunger 83*a* is not properly determined, the rocking movement of the key 73 or 74 will not be made in a desired manner with resulting deterioration in the quality of a sound produced.

It is, therefore, an object of the invention to provide a key actuating device of an automatic playing keyboard instrument which has eliminated the above described disadvantages of the prior art key actuating device.

SUMMARY OF THE INVENTION

A key actuating device of an automatic playing keyboard instrument achieving the above object of the invention has a plurality of key actuator units and each key actuator unit is provided for each of keys arranged above a key bed and comprises coil means provided above the upper surface of the key bed for producing a magnetic field corresponding to a current supplied from outside and passing therethrough in a direction substantially normal to a rocking direction of the key, a plunger fixedly provided on the lower surface of the key, and yoke means provided fixedly on the coil means and opposing the plunger, a relative area of portions of the yoke means and the plunger opposing each other or an interval between these portions being variable in the rocking direction of the key and the plunger being not in contact with the coil means or the yoke means at any position of the plunger in the rocking movement of the key.

According to the invention, a magnetic field is produced through the coil means and the yoke means by supplying a current to the coil means and a magnetic attraction thereby is produced between the yoke means and the plunger. Since the relative area of portions of the yoke means and the plunger opposing each other or an interval between these portions varies in the rocking direction of the key, a thrust characteristic with respect to the moving stroke of the key becomes flat as compared with the prior art impact system. This contributes particularly to improvement in a reproduced sound in a low speed key actuation region (e.g., reproduction of a weak sound or pianissimo performance).

According to the invention, the plunger is fixed to the key and is not in contact with the coil means or the yoke means at any position of the rocking movement of the key. Accordingly, different from the prior art key actuating device employing the impact actuation system, noise is hardly generated.

Besides, since there is no mechanical contact between the plunger and the coil means and the yoke means, damage or wear of the plunger and the lower surface of the key can be prevented, so that reliability and durability of the key actuating device are improved.

Since the plunger is provided integrally with the key, the movement of the key can be controlled not only during striking of the key but also during releasing of the key whereby the range of conrol is expanded and the accuracy of control is improved. Further, the half key technique can be reproduced and the performance by a rapid, repeated striking of the same key can be made more effectively.

Since the key can be always controlled in response to a current supplied to the coil means regardless of the position of the key, the feedback control can be performed very efficiently.

By providing a permanent magnet in the magnetic circuit formed by the coil means and the yoke means and extracting, on a time shared basis, a coil output voltage produced when the permanent magnet crosses the magnetic field, this circuit will be utilized as a key speed detection sensor.

In one aspect of the invention, the key actuating device comprises, in addition to the above described construction, the feature that the coil means is provided between a balance rail provided on the key bed and rockably supporting the key and a front rail provided on the key bed and being capable of engaging a front end portion of the key.

According to this aspect of the invention, the actuating force is applied to the key at a position between the balance rail and the front rail, so that the point of acting force applied to the key resembles that of a normal piano performance whereby a pianist's performance can be accurately reproduced. Besides, since the actuating force is applied between the balance rail and the front rail, the key actuating device can be applied to a broader range of pianos because the pitch of key arrangement in this portion of the key is standardized internationally. In comparison, the pitch of the key in the portion in which the prior art key actuating device is provided is not standardized internationally so that it is difficult to apply the prior art key actuating device to all types of piano.

According to another aspect of the invention, the key actuating device comprises, in addition to the first described construction, the feature that the coil means comprises a pair of coils and the yoke means comprises a pair of yokes corresponding to the pair of coils and a relative area of portions of one of the pair of yokes and the plunger opposing each other or an interval therebetween varies in opposite direction to a relative area of portions of the other of the pair of yokes and the plunger opposing each other or an interval therebetween.

According to this aspect of the invention, the pair of yokes exercise forces acting to the plunger in opposite directions and the plunger is moved in accordance with difference in these forces in either direction and, by controlling currents supplied to the coils, the direction and speed of actuating the key can be controlled. Accordingly, an execellent feedback control can be realized.

According to another aspect of the invention, the key actuating device comprises, in addition to the above described construction of having the pair of coils and pair of yokes, the feature that the pair of coils are arranged adjacent to each other transversely to the longitudinal direction of the key.

According to this aspect of the invention, the coils can be disposed collectively on one side of the plunger in a compact manner whereby assembling and adjusting of the device can be facilitated.

In another aspect of the invention, the key actuating device comprises, in addition to the above described construction of having the pair of coils and pair of yokes, the feature that the pair of coils and the pair of yokes are arranged in the longitudinal direction of the key with an interval between the respective coils and the respective yokes.

According to this aspect of the invention, a sufficiently large space for disposing the coils and the magnetic circuit can be secured so that a sufficiently large coil can be disposed as an individual coil constituting the pair of coils and a strong actuating force thereby can be applied to the key as required.

In another aspect of the invention, the key actuating device comprises, in addition to the first described construction, the feature that the plunger has a pair of downwardly extending portions arranged transversely to the longitudinal direction of the key thereby forming a downwardly opening space therebetween, the yoke means has a pair of upwardly extending portions arranged transversely to the longitudinal direction of the key thereby forming an upwardly opening space therebetween, and the plunger is movable in the upwardly opening space of yoke means.

According to this aspect of the invention, since the plunger has the downwardly opening space, a magnetic vector in the rocking direction of the key is generated between the plunger and the yoke means and, by utilizing a vertical component of this magnetic vector effectively, the key can be actuated accurately in the rocking direction thereof.

In still another aspect of the invention, the key actuating device comprises, in addition to the first described construction, the feature that the coil means comprises a first coil and a second coil arranged in the vertical direction for producing magnetic fields in the direction of the rocking movement of the key and respectively having an opening of width and length larger than width and length of the plunger, the plunger is movable in the openings of the first and second coils, and the yoke means comprises a top yoke connecting the upper surfaces of the first coils of all keys commonly and formed with slits each having larger width and length than the plunger and enabling the plunger to move therethrough, a pair of top subyokes provided between the top yoke and the first coil and each having a configuration such that a relative area of portions of the top subyoke and the plunger opposing each other increases toward the direction of the magnetic field produced by the first coil, a center yoke provided between the first and second coils for connecting the opposing surfaces of the first and second coils of all keys commonly and formed with slits each having larger width and length than width and length of the plunger and enabling the plunger to move therethrough, a base yoke connecting the lower surfaces of the second coils of all keys commonly and formed with slits each having larger width and length than width and length of the plunger and enabling the plunger to move therethrough and a pair of bottom subyokes provided between the base yoke and the second coil and each having a configuration such that a relative area of portions of the bottom subyoke and the plunger opposing each other increases toward the direction of the magnetic field produced by the second coil.

According to this aspect of the invention, a benefit can be derived, in addition to the benefits obtained from the first described construction, in that forming of a magnetic path by arranging the top yoke, top subyokes and center yoke about the first coil and a magnetic path by arranging the center yoke, bottom subyokes and base yoke about the second coil increases the absolute value of thrust.

These and other features and advantages of the invention will become more apparent from the description made below with reference to the accompanying drawings.

BRIEF DESCRIPTION OF THE DRAWINGS

In the accompanying drawings,

FIGS. 1A and 1B are views showing the first embodiment of the invention in which FIG. 1A is a side view of an essential part of the first embodiment of the key actuating device and FIG. 1B is a sectional view of the same part taken along lines A—A in FIG. 1A;

FIGS. 2A and 2B are views showing a modification of a plunger used in the first embodiment in which FIG. 2A is a side view of the plunger and FIG. 2B is a view taken in the direction of arrow B in FIG. 2A;

FIGS. 3A and 3B are views showing another modification of the plunger used in the first embodiment in which FIG. 3A is a side view of the plunger and FIG. 3B is a view taken in the direction of arrow C in FIG. 3A;

FIGS. 5A, 5B and 5C are views showing the second embodiment of the invention in which FIG. 5A is a side view of an essential part of the second embodiment, FIG. 5B is a perspective view of the same part, and FIG. 5C is an enlarged view partially showing the essential part for explaining generation of magnetic attraction;

FIGS. 6A and 6B are views showing the third embodiment of the invention in which FIG. 6A is a perspective view of an essential part of the third embodiment and FIG. 6B is a perspective view showing the coils in detail;

FIGS. 8A, 8B, 8C, 8D and 8E are views showing the fourth embodiment of the invention in which FIG. 8A is a side view of an essential part of this embodiment, FIG. 8B is a sectional view taken along lines D—D in FIG. 8A, FIG. 8C is a sectional view showing a modification of a plunger used in the fourth embodiment and FIGS. 8D and 8E are sectional views showing other modifications of the plunger used in the fourth embodiment;

FIGS. 10A and 10B are views showing the fifth embodiment of the invention in which FIG. 10A is a side view of an essential part of the fifth embodiment and FIG. 10B is a sectional view taken along lines E—E in FIG. 10A;

FIGS. 13A, 13B and 13C are views showing an example of the fifth embodiment incorporated in a keyboard instrument in which FIG. 13A is an explosive perspective view, FIG. 13B is a side view of an essential part thereof, and FIG. 13C is a sectional view taken along lines F—F in FIG. 13B;

FIGS. 15 to FIG. 19 are views showing the sixth embodiment of the invention in which FIG. 15 is an explosive perspective view showing an essential part of the sixth embodiment, FIG. 16 is a vertical sectional view showing a keyboard section of a keyboard instrument, FIG. 17 is a perspective view showing an essential part of this embodiment, FIG. 18 is a sectional view taken along lines G—G in FIG. 19, and FIG. 19 is a front view of the essential part in vertical section.

DESCRIPTION OF PREFERRED EMBODIMENTS

First Embodiment

Figure 1B:
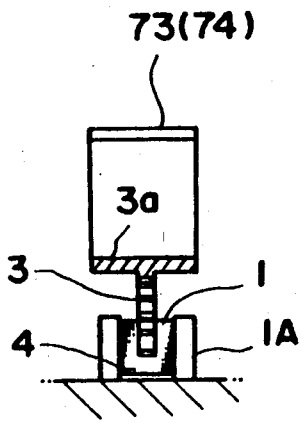
Figure 1A:
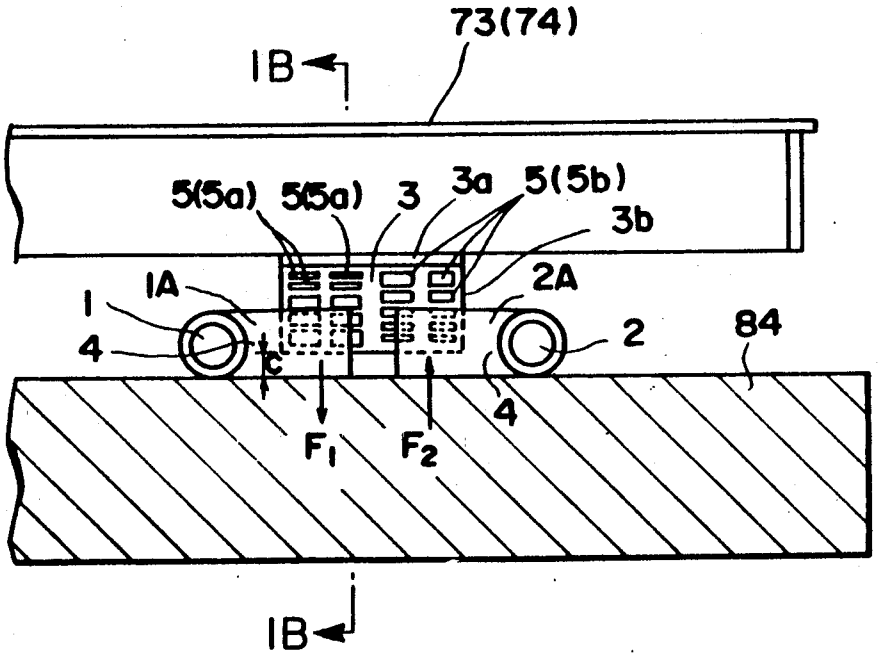
Figure 20:
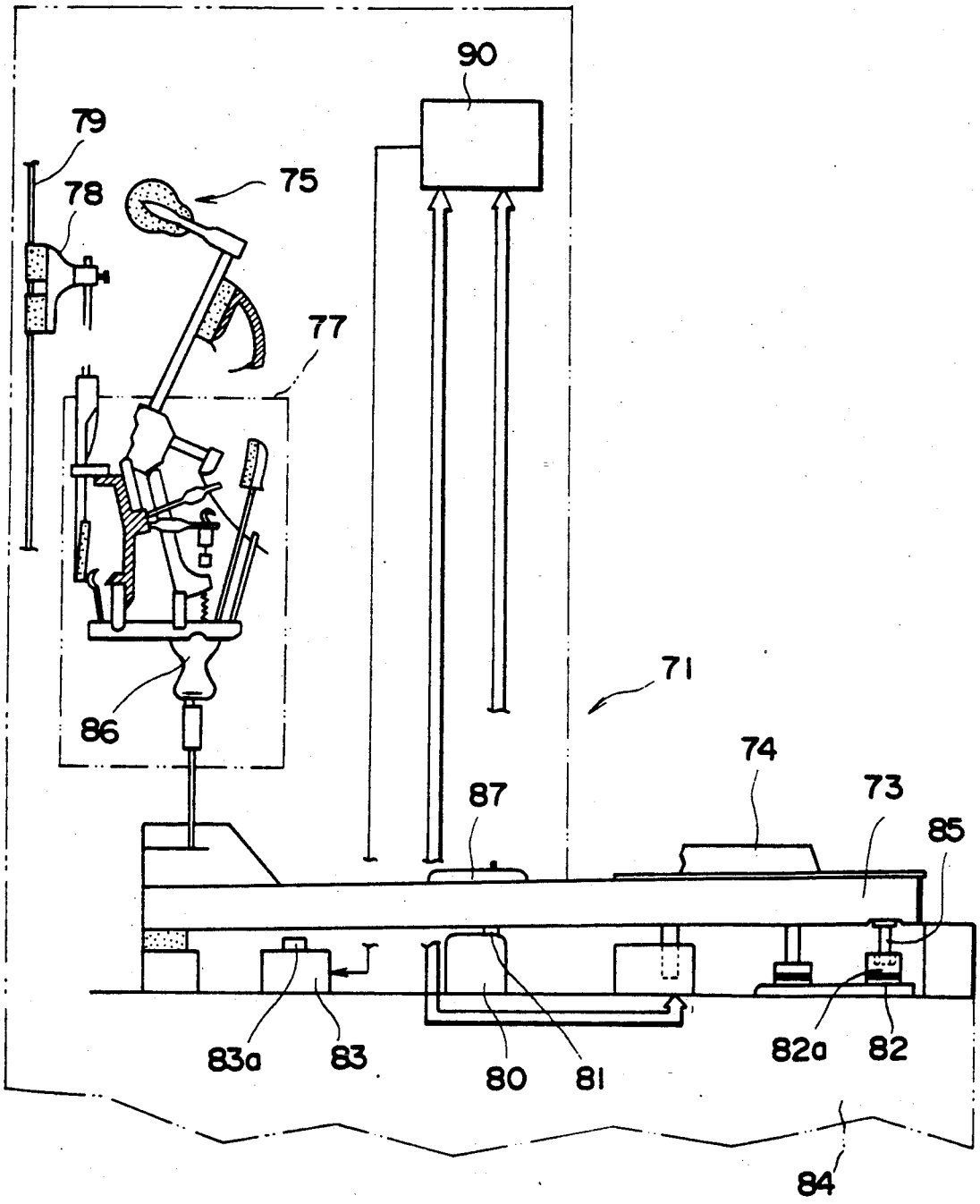
FIG. 20 PRIOR ART
FIG. 20 is a sectional view showing an example of a prior art key actuating device of an automatic playing keyboard instrument.

FIGS. 1A and 1B show the first embodiment of the invention. In these and subsequent figures, component parts corresponding to those of FIG. 20 are designated by the same reference characters and detailed description thereof will be omitted.

As shown in FIG. 1A, the key actuating device of this embodiment has a pair of coils 1 and 2 provided on the upper surface of a key bed 84 between a balance rail 80 and a front rail 82, a pair of yokes 1A and 2A fixedly provided on the coils 1 and 2 and a plunger 3 which is fixedly provided on the lower surface of a key 73 or 74.

The yokes 1A and 2A are made of a ferromagnetic material and formed in a cross section of U-shape to define an opening 4. The yokes 1A and 2A are provided in the longitudinal direction of the key 73 or 74 with an interval therebetween with their openings 4 being opposed to each other and with the plunger 3 being inserted in the openings 4. The coils 1 and 2 are fixed at a middle portion of each yoke 1A or 2A so as to produce a magnetic field in the direction normal to the rocking direction of the key 73 or 74.

The plunger 3 is made of a ferromagnetic material and formed in a cross section of T-shape. An upper flat surface **3*a* of the plunger 3 is fixed on the lower surface of the key 73 or 74 by means of a screw or bonding agent. A downwardly extending portion 3*b* of the plunger 3 is provided in the longitudinal direction of the key 73 or 74 in such a manner that the lower end thereof extends to the vicinity of the lower end portions of the yokes 1A and 2A so that the downwardly extending portion 3*b* of the plunger 3 will be able to oppose the yokes 1A and 2A even in a state where the key 73 or 74** is not actuated for producing a sound. A gap C is provided between the lower edge of the downwardly extending portion 3*b* and the key bed 84 so as to enable the key 73 or 74 to be moved down when it has been depressed.

The plunger 3 is formed with windows 5 (5*a*, 5*b*) of different areas of opening which are arranged vertically and in four rows in the horizontal direction. In FIG. 1A, the windows 5*a* of the two rows on the left side are formed in such a manner that their areas of opening increase progressively from the uppermost windows downwardly and the windows 5*b* of the two rows on the right side are formed in such a manner that their areas of opening increase progressively from the lowermost windows upwardly, in inverse relation to the windows 5*a*. The portion of the plunger 3 including the windows 5*a* of the two left side rows opposes the yoke 1A on the left side and the portion of the plunger 3 including the windows 5*b* of the two right side rows opposes the yoke 2A on the right side. Thus, the left side portion and right side portion of the plunger 3 which respectively oppose the yokes 1A and 2A are so formed that relative areas of these portions opposing the yokes 1A and 2A vary in inverse relation.

The coils 1 and 2 are electrically connected to a control unit (not shown) in the same manner as in the prior art key actuating device, so that magnitudes and directions of currents supplied to these coils 1 and 2 are individually controlled.

The operation of the above described embodiment will now be described.

As the currents flow from the unillustrated control unit to the coils 1 and 2, magnetic fields having directions corresponding to the directions of the currents are produced about the coils 1 and 2 and magnetic loops are thereby formed between the yokes 1A, 2A and the plunger 3 and an actuating force is produced between the yokes 1A, 2A and the plunger 3.

The areas of the plunger 3 opposing the yokes 1A and 2A are variable by forming of the windows 5 in the plunger 3. In FIG. 1A, the left side portion of the plunger 3 is subjected to a downwardly acting force F1 and the right side portion of the plunger 3 is subjected to an upwardly acting force F2 when the current flows through the coil 1. In accordance with difference between the forces F1 and F2, the key 73 or 74 to which the plunger 3 is fixed is subjected to a downwardly or upwardly actuating force. The speed of actuation of the key is determined by the magnitude of the current supplied to the coil 1 or 2.

Figure 7:
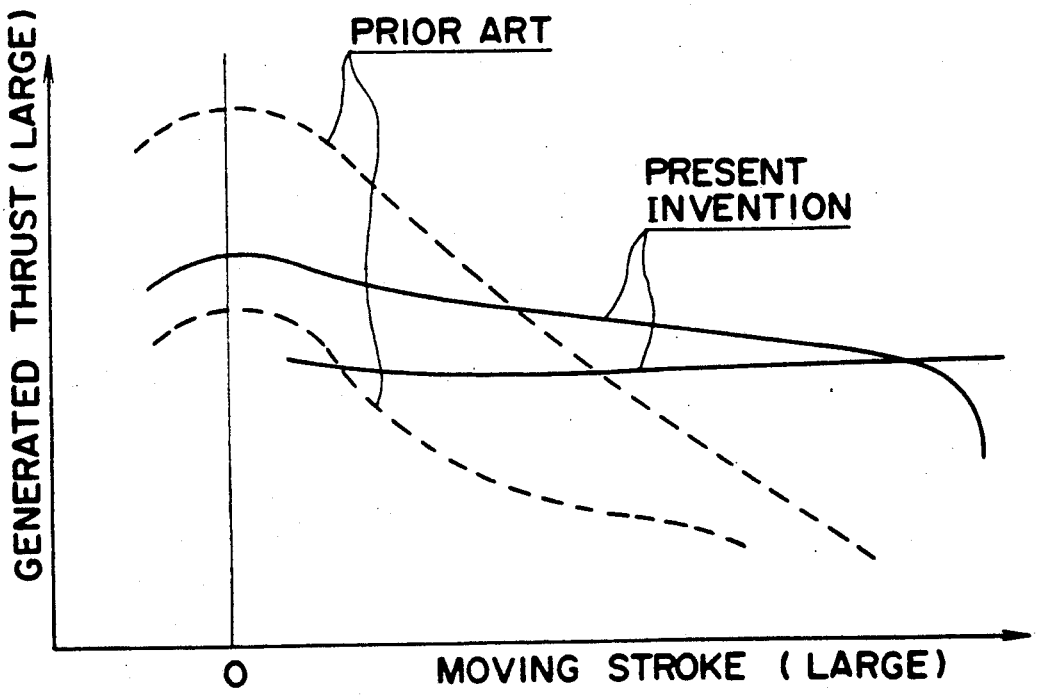
FIG. 7 is a graph showing the operation principle of the key actuating device according to the invention.

The actuating force pushing up or down the key 73 or 74 is provided by magnetic attraction produced between the yokes 1A, 2A and the plunger 3. Since the rate of change of the total area of opening of the plunger 3 to each of the yokes 1A and 2A is substantially maintained constant at any position in the rocking movement of the key 73 or 74 owing to the above described forming of the windows 5, the actuating force, i.e., thrust, is maintained substantially constant so long as the magnitude of the current remains the same as shown in FIG. 7. As the key-striking and key-releasing strength characteristic becomes substantially flat as shown in FIG. 7, the accuracy of control of the key 73 or 74 is improved. This is because the plunger 3 which is made of a high-magnetic permeability substance such as iron is provided in the magnetic field, so that a force acts on the plunger 3 in a direction in which reluctance of the magnetic path becomes minimum.

Figure 2B:
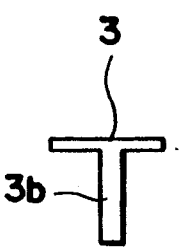
Figure 2A:
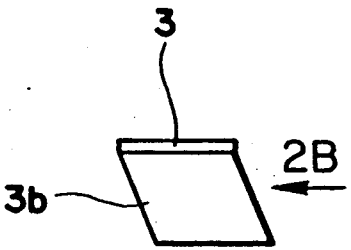

A modified example of the plunger 3 of the first embodiment is shown in FIGS. 2A and 2B.

In the above described embodiment, for varying the areas of the left side portion and the right side portion of the plunger 3 opposing the yokes 1A and 2A, the windows 5 (5*a* and 5*b*) of different sizes are formed in the downwardly extending portion 3*b* of the plunger 3. In the modified example shown in FIGS. 2A and 2B, the above construction is substituted by a construction according to which the downwardly extending portion 3*b* is formed in a substantially parallelogram configuration with its opposing end surfaces in the longitudinal direction of the key 73 or 74 being inclined in substantially the same direction.

In this construction also, when the current flows through the coils 1 and 2, the plunger 3 can obtain thrust forces acting in vertically opposite directions from the left and right coils 1A and 2A and striking and release of the key 73 or 74 can be achieved by controlling the currents supplied to the coils 1 and 2. This construction facilitates processing of the plunger 3 in the manufacturing process of the key actuating device with resulting reduction of the manufacturing cost.

Figure 3B:
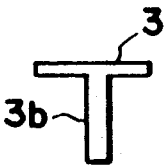
Figure 3A:
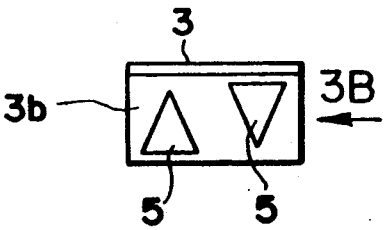

FIGS. 3A and 3B show another modification of the plunger 3.

In this modification, the plunger 3 has a downwardly extending portion 3*b* having two triangular windows 5 one of which is formed with its one apex pointing downwardly and the other of which is formed with its pointing upwardly. The triangular windows 5 occupy about half of the downwardly extending portion 3*b*.

By this construction also, the areas of the left side portion and the right side portion of the plunger 3 opposing the yokes 1A and 2A can be made variable and, by controlling the currents supplied to the coils 1 and 2, striking and releasing of the key 73 or 74 can be controlled.

Figure 4:
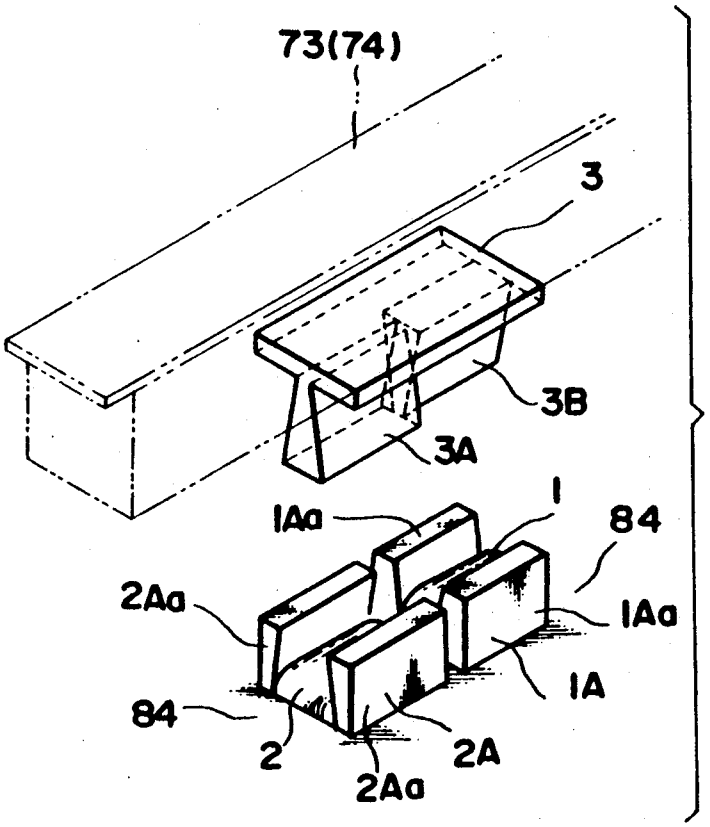
FIG. 4 is a perspective view showing an example of a combination of yokes and a plunger.

FIG. 4 shows a modified example of the plunger 3 and the yokes 1A and 2A corresponding thereto.

In this example, the plunger 3 is divided into two portions, namely a first vertically extending portion 3A having a wedge-like section with its thickness increasing progressively downwardly and a second vertically extending portion 3B having a wedge-like section with its thickness decreasing progressively downwardly. These two vertically extending portions 3A and 3B are arranged in a staggered manner in the longitudinal direction of the key 73 or 74.

The pair of yokes 1A and 2A also are disposed in a staggered manner in the longitudinal direction of the key 73 or 74 in correspondence to the vertically extending portions 3A and 3B of the plunger 3. The yoke 2A is composed of two wedge-like members 2A*a*, 2A*a* made of a ferromagnetic material arranged in parallel with an internal therebetween which progressively decreases upwardly. The other yoke 1A is composed of two wedge-like members 1A*a*, 1A*a* made of ferromagnetic material arranged in parallel with an interval therebetween which progressively increases upwardly.

As the plunger 3 moves downwardly with the key 73 or 74, the cross section of the vertically extending portion 3A crossing the magnetic field produced by the yoke 2A decreases whereas the cross section of the vertically extending portion 3B crossing the magnetic field produced by the yoke 1A increases.

Since the relative areas of the portions of the plunger 3 opposing the yokes 1A and 2A vary in inverse direction in this construction also, thrust forces in vertically opposite directions act on the vertically extending portions 3A and 3B of the plunger 3 and, accordingly, striking and releasing of the key 73 or 74 can be made by controlling the currents supplied to the coils 1 and 2.

Second Embodiment

Figure 5A:
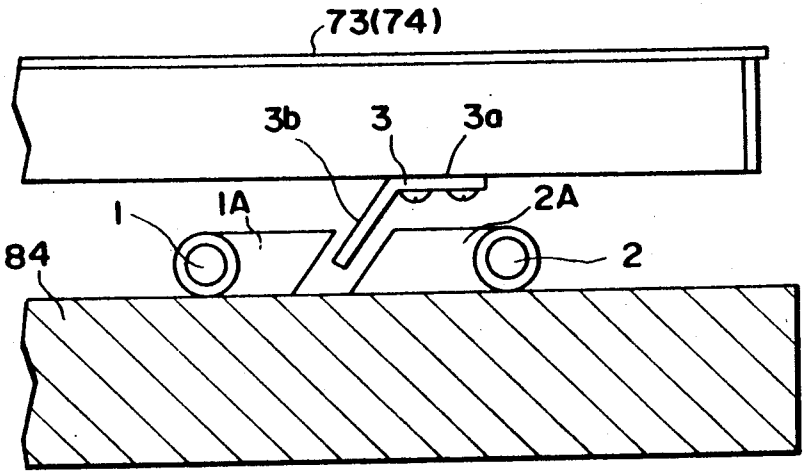
Figure 5C:
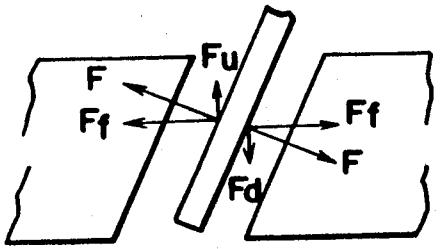
Figure 5B:
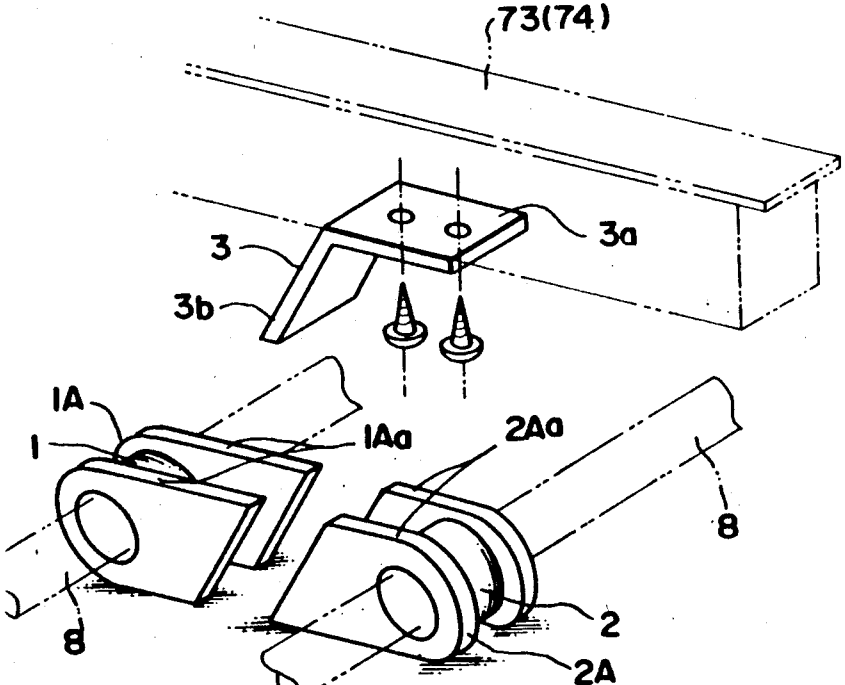

FIGS. 5A to 5C show the second embodiment of the invention. In these figures, the same or like component parts as those in FIGS. 1A, 1B, 2A and 2B are designated by the same or like reference characters and detailed description thereof will be omitted.

In this embodiment, the plunger 3 has an upper horizontal portion 3*a* screwed to the lower portion of the key 73 or 74 and also has an obliquely downwardly extending portion 3*b* having inclined end surfaces in the longitudinal direction of the key 73 or 74. The pair of yokes 1A and 2A are arranged in the longitudinal direction of the key 73 or 74 with an interval therebetween so that the plunger 3 is movable in the interval.

The yoke 1A (2A) has, as shown in FIG. 5B, a pair of ferromagnetic plate members 1A*a*, 1A*a*. The coil 1 (2) is provided between these ferromagnetic plate members 1A*a*, 1A*a* and a common shaft yoke 8 is inserted through the central portion of the coil 1. The yoke 1A (2A) has opposing end surfaces which are inclined in the same direction as the end surface of the obliquely downwardly extending portion 3*b* of the plunger 3.

The reason for forming the end surfaces of the vertically extending portion 3*b* of the plunger 3 and the ferromagnetic plate members 1A*a*, 1A*a* of the yokes 1A (2A) in inclined surfaces is that a vertical component of the force F by which the plunger 3 is attracted can be obtained by the magnetic field produced between the pair of yokes 1A and 2A. By adjusting the angle of the plunger 3, thrust characteristic to the stroke can be adjusted.

In this embodiment, as the key 73 or 74 is moved down, the interval between the plunger 3 and the yoke 2A on the right side in the figure decreases (i.e., the gap decreases), downward attraction increases and, as a result, downward thrust also increases. On the other hand, the interval between the plunger 3 and the left side yoke 1A increases (i.e., the gap increases), upward attraction decreases and, as a result, upward thrust also decreases.

Thus, since the interval (gap) of the plunger 3 to the opposing yokes 1A and 2A varies, thrust forces in vertically opposite directions act on the plunger 3 by controlling the currents supplied to the coils 1 and 2 and striking and releasing of the key 73 or 74 can thereby be controlled.

In this embodiment, the plunger 3 can be constructed simply by bending a single oblong ferromagnetic plate member, so that the construction of the plunger 3 can be simplified and reduction of the manufacturing cost can be realized.

Further, since the common shaft yoke 8 is used for mounting the yoke 1A (2A) to the key bed 84, yokes for all keys (88 keys) can be assembled altogether. There is some likelihood that the yoke 1A (2A) may be offset slightly to the left or right with respect to the plunger 3 (i.e., in the axial direction of the common shaft yoke 8) in assembling the yokes. Since, however, the actuating force acting on the plunger 3 is maintained by balance between the opposing coils 1 and 2, such slight offsetting of the yoke 1A (2A) will not seriously affect the key striking and releasing operations.

Third Embodiment

Figure 6A:
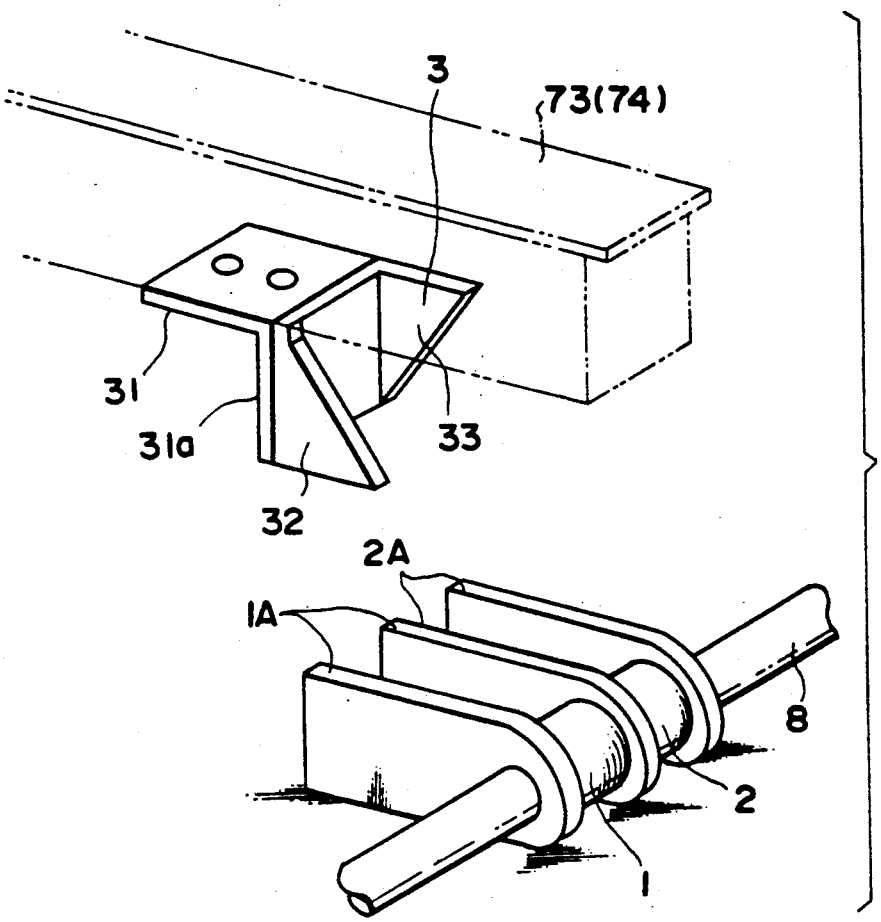
Figure 6B:
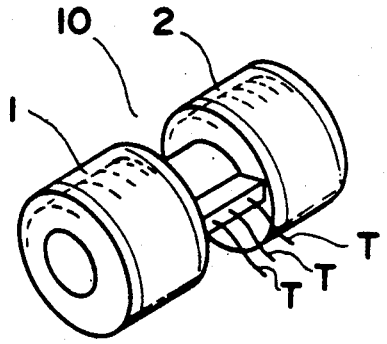

FIGS. 6A and 6B show the third embodiment of the invention.

In this embodiment, the coils 1 and 2 are fixedly provided on one side of the plunger 3 in such a manner that they produce magnetic fields in opposite directions. The yokes 1A and 2A are also provided in parallel with an interval which is about half of the interval of the yokes in the above described embodiment.

As the coils 1 and 2, two coils as shown in FIG. 6B which are assembled in a coil bobbin 10 are used. The employment of such coils facilitates winding of coils and fixing of the coils to the key bed 84. Three terminals T extend from the coil bobbin 10 and one of these terminals T can be used as a common terminal.

The plunger 3 has an L-shaped support plate 31 a horizontal portion of which is fixed to the lower surface of the key 73 or 74 by means of fastening means such as screws. Triangular plate portions 32 and 33 are provided at vertical end portions of a vertically extending portion 31*a* of the support plate 31 so that these plate portions 32 and 33 cross the vertically extending portion 31*a* and are positioned in the spaces defined between the ferromagnetic plate members of the yokes 1A and 2A. One end surfaces of the triangular plate portions 32 and 33 in the longitudinal direction of the key 73 or 74 are inclined in opposite directions to each other.

In this embodiment also, when the currents are supplied to the coils 1 and 2 and the key 73 or 74 is moved downwardly, for example, the area of the plunger 3 opposing the yoke 1A decreases and the area thereof opposing the yoke 2A increases.

Since the areas of the plunger 3 opposing the yokes 1A and 2A vary in opposite directions, thrust forces in vertically opposite directions act on the plunger 3 and, accordingly, by controlling the currents supplied to the coils 1 and 2, the key striking and releasing operations can be controlled.

In this embodiment, the yokes 1A and 2A and the coils 1 and 2 can be disposed on one side of the plunger 3, so that a compact design of the key actuating device can be realized.

Fourth Embodiment

FIGS. 8A to 8D show the fourth embodiment of the invention.

Figure 8B:
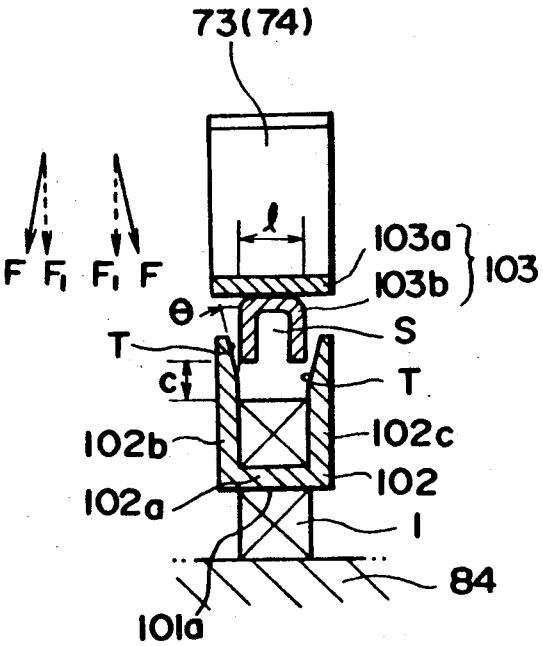
Figure 8A:
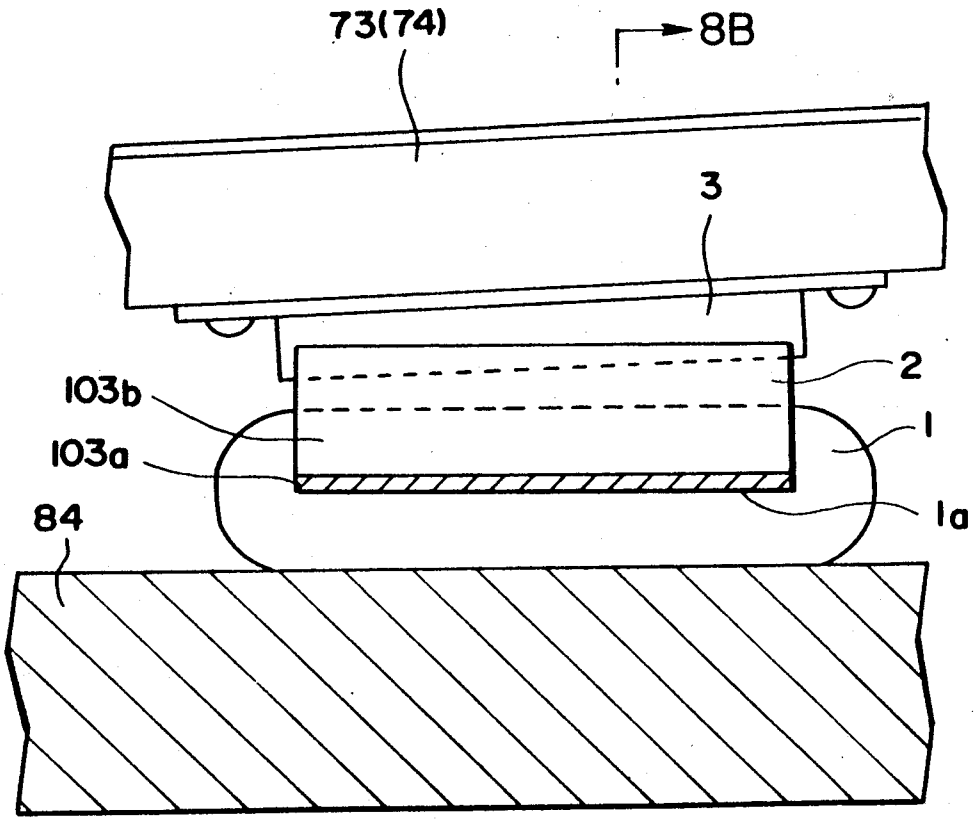

As best shown in FIG. 8A, the key actuating device of this embodiment has a coil 101 which is fixedly provided on the upper surface of the key bed 84 between the balance rail 80 and the front rail 82, a yoke 102 which is fixed to the coil 101 and a plunger 103 which is fixed on the lower surface of the key 73 or 74.

The coil 101 is disposed in a direction in which it can produce a magnetic field in a direction normal to the rocking direction of the key 73 or 74 when a current flows through the coil 101.

The yoke 102 is provided at a location at which it opposes the plunger 103 in close proximity and in such a manner that the relative area of the portion of the yoke 102 opposing the plunger 103 varies in the rocking direction of the key 73 or 74. More specifically, the yoke 102 has, as shown in FIG. 8B, a horizontal plate portion 102*a* which is inserted in a central opening 101*a* of the coil 101 and a pair of upwardly extending plates 102 and 102*c* formed on both sides of the horizontal plate 102*a* and arranged in transversely to the longitudinal direction of the key 73 or 74 with an interval therebetween and in a manner to embrace the coil 101. Thus, the yoke 102 is formed in an upwardly opening U-shape and an upwardly opening space is thereby formed between the upwardly extending plates 102*b* and 102*c* above the coil 101. The upwardly extending plates 102*b* and 102*c* are formed with taper portions T of upwardly decreasing thickness.

The plunger 103 has a fixing plate portion 103*a* which is fixed to the lower surface of the key 73 or 74 by means of screws or the like fixing means and a plunger main body portion 103*b* which has a pair of downwardly extending portions arranged transversely to the longitudinal direction of the key 73 or 74 thereby forming a downwardly opening space S therebetween. Thus, the plunger main body 103*b* is formed in a downwardly opening U-shape.

The plunger 103 is positioned on the same axis as the coil 101 and the yoke 102. The width 1 of the plunger 103 is so determined that, when the plunger main body 103*b* has been moved down, the main body 103*b* will be positioned in the space between the plates 102*b* and 102*c* of the yoke 102 with a sufficient clearance left against the plates 102*b* and 102*c* so as not to interfere with these plates 102*b* and 102*c*. There is also provided a clearance C between the lower end of the plunger main body 103*b* and the upper surface of the coil 101 so as to allow the key 73 or 74 to be moved down.

The yoke 102 and plunger 103 are made of ferromagnetic material.

The coil 101 is electrically connected to the control unit, so that the magnitude and direction of the current flowing the coil 101 can be controlled as desired.

The operation of the above described fourth embodiment will now be described.

When the current is supplied from the control unit to the coil 101, a magnetic field corresponding to the direction of the current is produced about the coil 101 and a magnetic loop thereby is formed through the coil 101, the yoke 102 and the plunger 103. Magnetic attraction thereby is produced between the yoke 102 and the plunger 103 and the key 73 or 74 is moved down with the plunger 103 by this magnetic attraction. The magnitude of this attraction is determined by the magnitude of the current supplied to the coil 101.

Figure 9:
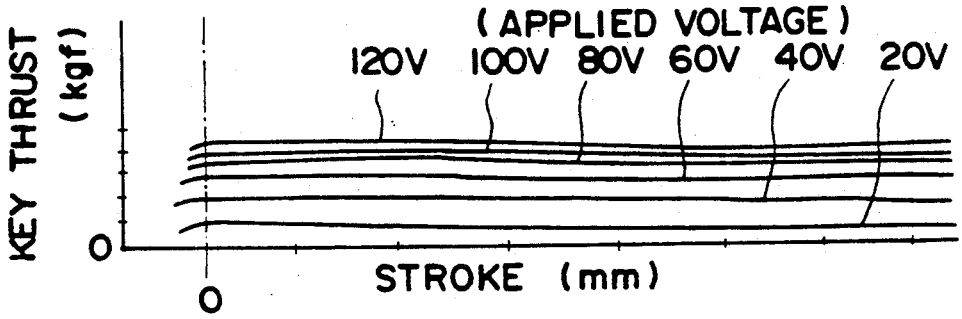
FIG. 9 is a graph showing a key thrust characteristic of the fourth embodiment.

The attraction to the key 73 or 74 which is produced by magnetic force produced between the yoke 102 and the plunger 103 varies somewhat according to the vertical position of the key 73 or 74. Assuming that the magnitude of the current supplied to the coil 101 is maintained constant, this variation in the magnetic attraction is determined by the angle $\theta$ of the taper portions T of the upwardly extending plates 102*b* and 102*c* of the yoke 102. By setting this angle $\theta$ suitably, therefore, key-thrust-to-stroke (vertical position of the key) characteristic can be made substantially flat as shown in FIG. 9.

Since the opening S is formed in the central portion of the plunger main body 103*b*, a magnetic vector F in the rocking direction of the key 73 or 74 is generated between the plunger 103 and the yoke 102 and, by effectively utilizing the vertical component F1 of this magnetic vector F, the key 73 or 74 can be actuated accurately in the rocking direction of the key 73 or 74. If there was no opening S in the plunger 103 but instead the plunger 103 was made solid in its central portion, short-circuiting of flux would be generated and this would make it difficult to obtain a flat key-thrust characteristic regardless of the vertical position of the key 73 or 74.

Since the coil 101 is fixedly provided on the key bed 84, wiring is easier and assembly of the device therefore is easier than in a case where the coil 101 is provided on the key 73 or 74 which is a moving element.

Some modified examples of the fourth embodiment will now be described. The same components as those shown in FIGS. 8A and 8B are designated by the same reference characters.

Figure 8E:
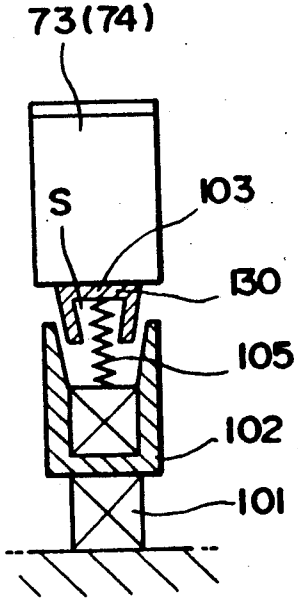
Figure 8D:
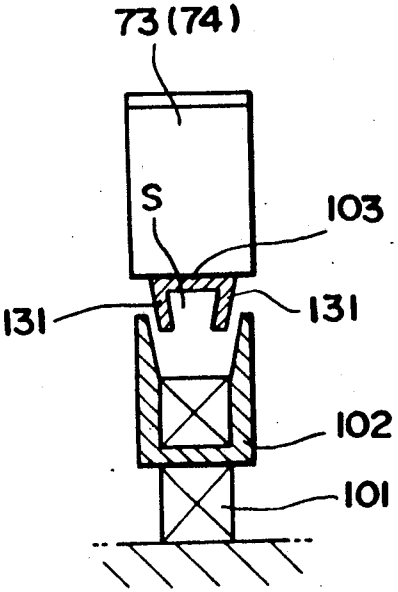
Figure 8C:
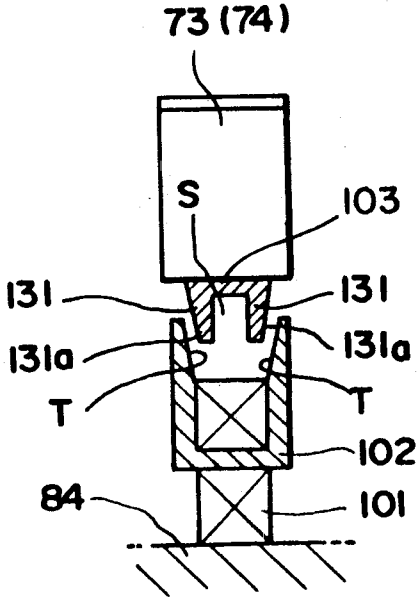

FIG. 8C shows another example of the plunger 103. In the embodiment of FIGS. 8A and 8B, the plunger 103 is composed of two members. In contrast thereto, the plunger 103 of this example is made up of a single member formed in a cross section of a U-shape. This plunger 103 can be formed easily by drawing or extrusion process. Outer side surfaces 131*a*, 131*a* of downwardly extending portions 131, 131 are tapered with a downwardly decreasing thickness in conformity to the taper portions T of the yoke 102. By employing this plunger 103 of a single member, the number of members required for assembling the device is reduced and manufacturing process and cost are thereby reduced and, besides, quality control of the components is facilitated. This benefit is particularly great in a piano since 88 keys are used in a piano.

FIG. 8D shows another example of the plunger 103. In this example, the plunger 103 is made by bending a single piece of plate and the downwardly extending portions 131, 131 are bent inwardly over 90 degrees, in the same manner as in the example of FIG. 8C. The same functions and benefits as the above described examples of FIGS. 8A to 8C can be obtained from this example.

FIG. 8E shows still another example of the plunger 103. The plunger 103 of this example has a helical spring 105 provided between the upper surface of the coil 101 and the lower surface of the horizontal plate 103*a* of the plunger 103. By the provision of this helical spring 105, load of the plunger 3 which is an extra load to the key 73 or 74 can be alleviated, so that the same key touch of a key which is not provided with the plunger 103 can be obtained from the key 73 or 74 which is provided with the plunger 103. Besides, dynamic characteristic of the key actuating system can be adjusted by adjusting the helical spring 105 whereby stability of the key actuating system during the feedback control can be enhanced.

Fifth Embodiment

Figure 10B:
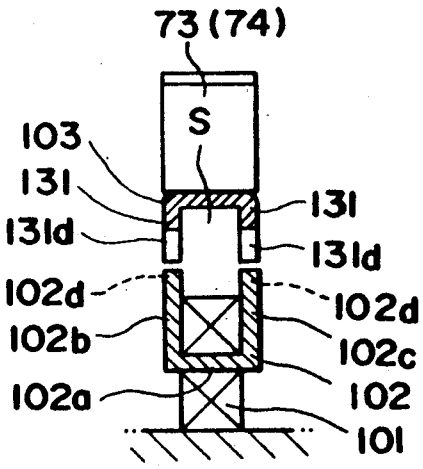
Figure 10A:
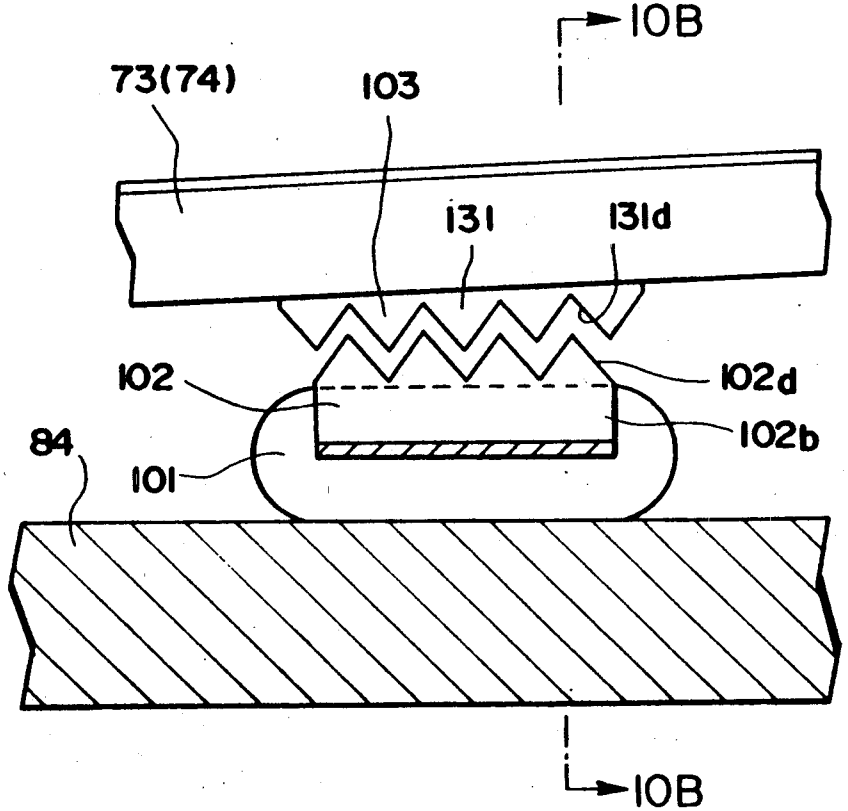

FIGS. 10A and 10B show the fifth embodiment of the invention. The same components as those in the fourth embodiment are designated by the same reference characters and detailed description thereof will be omitted.

As shown in FIGS. 10A and 10B, the upwardly extending plates 102*b* and 102*c* of the yoke 102 which is fixed to the coil 101 are formed in their upper end portions with a saw-tooth portion 102*d*. The downwardly extending portions 131, 131 of the plunger 103 are likewise formed in their lower end portions with a saw-tooth portion 131*d* which conforms to the saw-tooth portion 102*d* of the yoke 102. By this arrangement, when the plunger moves in the rocking motion with the key 73 or 74, the area of cross section of the yoke 102 corresponding to the plunger at a given position (i.e., an equivalent amount to the area of a portion of the yoke 102 opposing the plunger 103) varies. In the fourth embodiment, the equivalent amount to the area of a portion of the yoke 102 opposing the plunger 103 is made variable by varying the thickness of the upwardly extending plates 102*b* and 102*c*. In the fifth embodiment, variation in the equivalent amount can be obtained by forming the portion opposing the yoke 102 into a saw-tooth portion. The saw-tooth portions 102*d* and 131*d* of the yoke 102 and the plunger 103 are so designed that they respectively have an an even number of inclined surfaces opposing each other.

Figure 11:
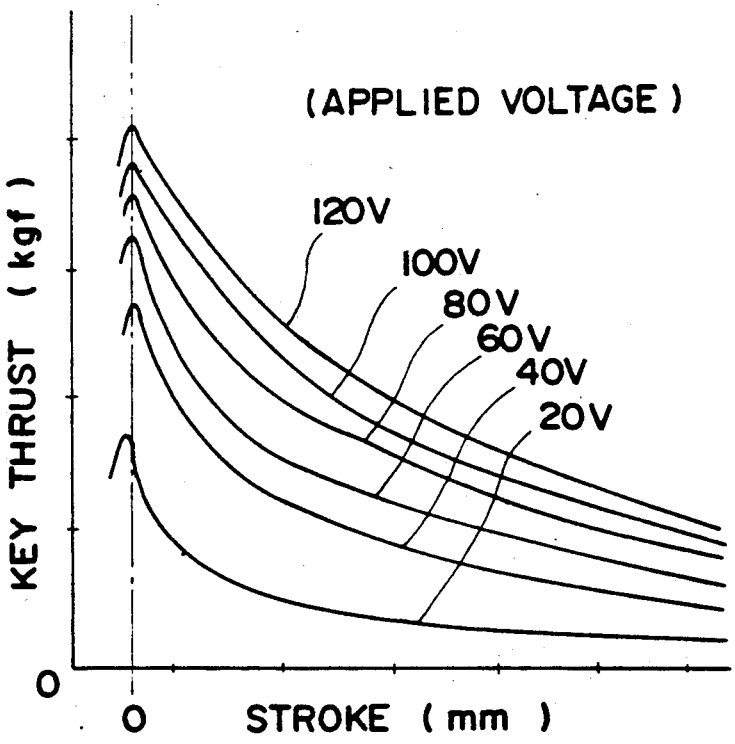
FIG. 11 is a graph showing a key thrust characteristic of the fifth embodiment.

In the key actuating device of the fifth embodiment, when the current is supplied from the control unit to the coil 101, the key 73 or 74 moves down due to magnetic attraction between the yoke 102 and the plunger 103. At this time, the interval between the plunger 103 and the yoke 102 decreases and the area of cross section (the equivalent amount to the opposing area) of the plunger 103 crossing the magnetic field produced by the yoke 102 increases. Since the relative area of portions of the yoke 102 and the plunger 103 opposing each other varies in this manner, key thrust characteristic relative to the moving stroke of the plunger 103 can be determined as desired by suitably setting the angle of inclination of the saw-tooth portions 102*d* and 131*d*. Accordingly, by suitably setting the angle of inclination of the saw-tooth portions 102*d* and 131*d* and adjusting the magnitude of the current supplied to the coil 101, the striking and releasing operations for the key 73 or 74 which is integral with the plunger 103 can be controlled. Further, by suitably setting the angle of inclination of the saw-tooth portions 102*d* and 131*d*, a relatively flat key-thrust characteristic as shown in FIG. 11 which is easy for performing a key thrust control can be obtained.

Since the number of the inclined surfaces constituting the saw-tooth portions 102*d* and 131*d* is an odd number, horizontal components of the magnetic force are cancelled by each other while vertical components of the magnetic force act effectively as thrust, so that the horizontal components do not adversely affect the key actuating force.

Figure 12:
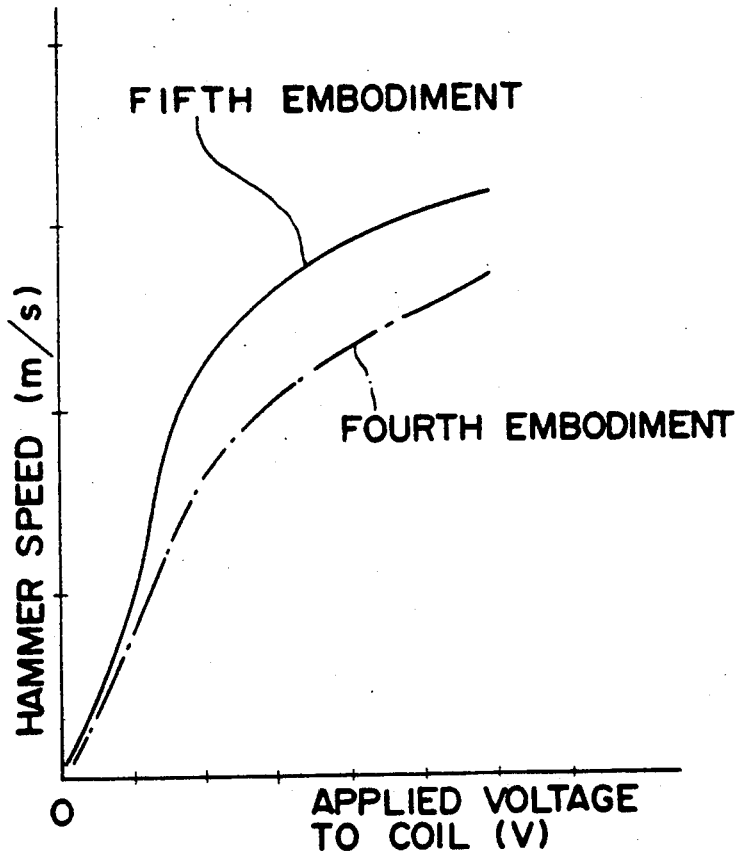
FIG. 12 is a graph showing speeds of the hammer when the hammer is actuated by the fourth and fifth embodiments of the key actuating device.

FIG. 12 shows the hammer speed obtainable when the key 73 or 74 is actuated with the fourth or fifth embodiment of the key actuating device. By controlling input voltage applied to the coil 101 as shown in FIG. 12, the speed of the hammer 75 striking the string 79 can be controlled as desired. Besides, since the hammer speed changes in a curve which is nearly flat as will be apparent from the figure, control of the hammer speed can be made easily.

Figure 13A:
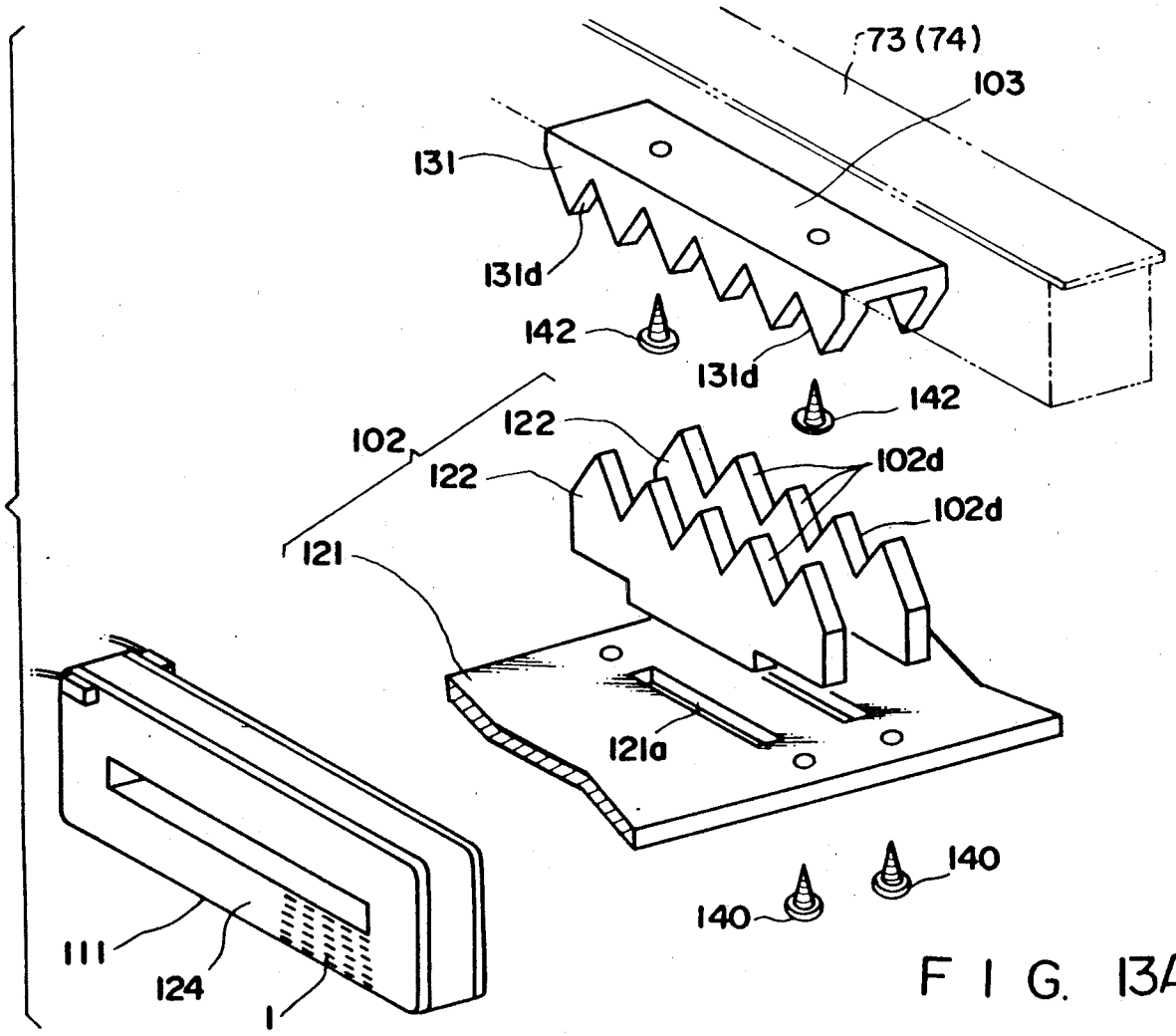
Figure 13C:
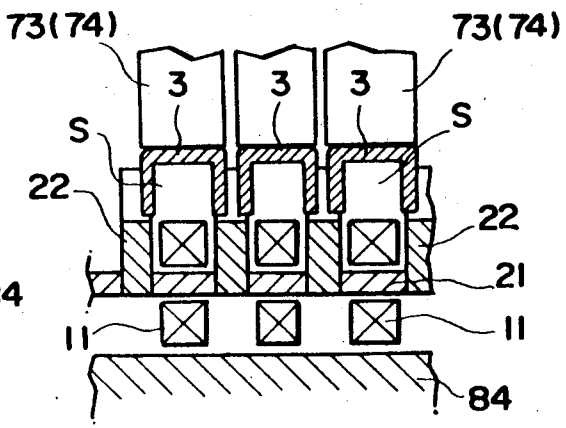
Figure 13B:
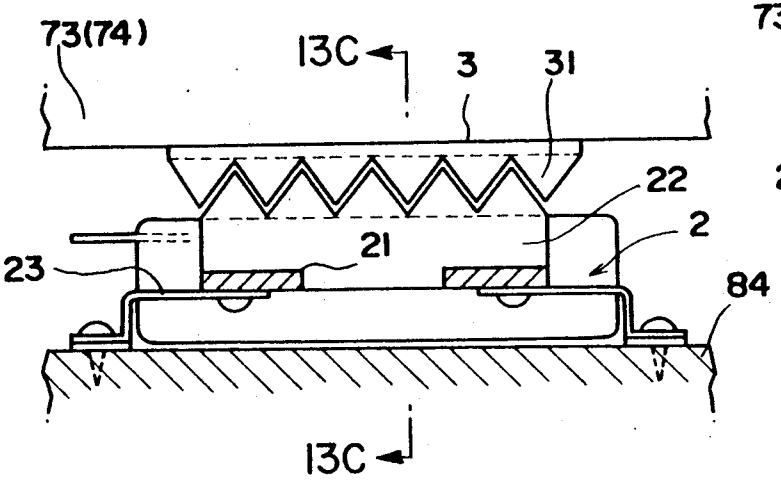

FIGS. 13A to 13C show an example in which the fifth embodiment of the key actuating device has been actually mounted on a keyboard instrument. As shown in these figures, the yoke 102 is composed of a common coil plate 121 and upwardly extending plates 122 which are inserted in slits 121*a* formed with a predetermined interval in the longitudinal direction of the coil plate 121 and fixed on the upper surface of the coil plate 121 by means of screws 140. The common coil plate 121 is fixed at a predetermined location on the keyboard instrument by fastening it through a stay 123 as shown in FIG. 13B. A coil unit 111 incorporating the coil 101 in a case 124 is disposed between the upward extending plates 122 on the common coil plate 121.

The plunger 103 is directly fixed on the lower surface of the key 73 or 74 by means of screws 142. The thickness of the downwardly extending portions 131 of the plunger 103 is designed to become about half the thickness of the upwardly extending plates 122 of the yoke 102. The two adjacent downwardly extending portions 131 of the adjacent plungers 103 are positioned above one common upwardly extending plate 122 of the yoke 102.

According to this arrangement, the coil plate 121 of the yoke 102 can be utilized commonly for a plurality of yokes 102 and, besides, one upwardly extending plate 122 of the yoke 102 can be commonly utilized for two downwardly extending portons 131, so that assembly of the key actuating device is facilitated and the manufacturing cost is reduced.

Even when the plunger 103 is offset toward left or right against the yoke 102, relative area of opposing portions of the plunger 103 and the yoke 102 does not change so much and the key thrust characteristic is hardly affected.

Figure 14:
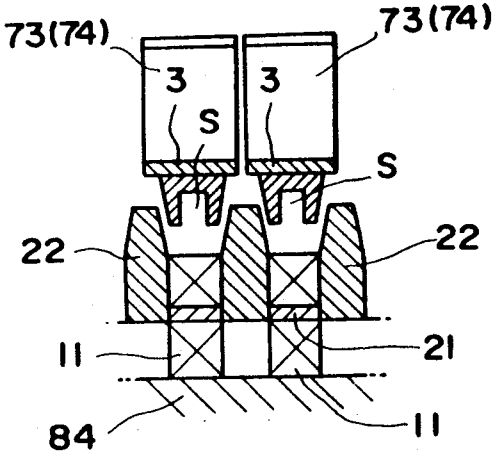
FIG. 14 is a sectional view showing an example of the fourth embodiment incorporated in a keyboard instrument.

FIG. 14 shows an example in which the fourth embodiment of the key actuating device has been actually mounted in a keyboard instrument. In this example also, the coil plate 121 of the yoke 102 is used commonly for a plurality of yokes 102 and one upwardly extending plate 122 is used commonly for two adjacent downwardly extending portions 131 of the plungers 103, so that the same benefits as those obtainable from the example of FIGS. 13A to 13C can be obtained.

Sixth Embodiment

FIGS. 15 to 19 show the sixth embodiment of the invention.

Figure 15:
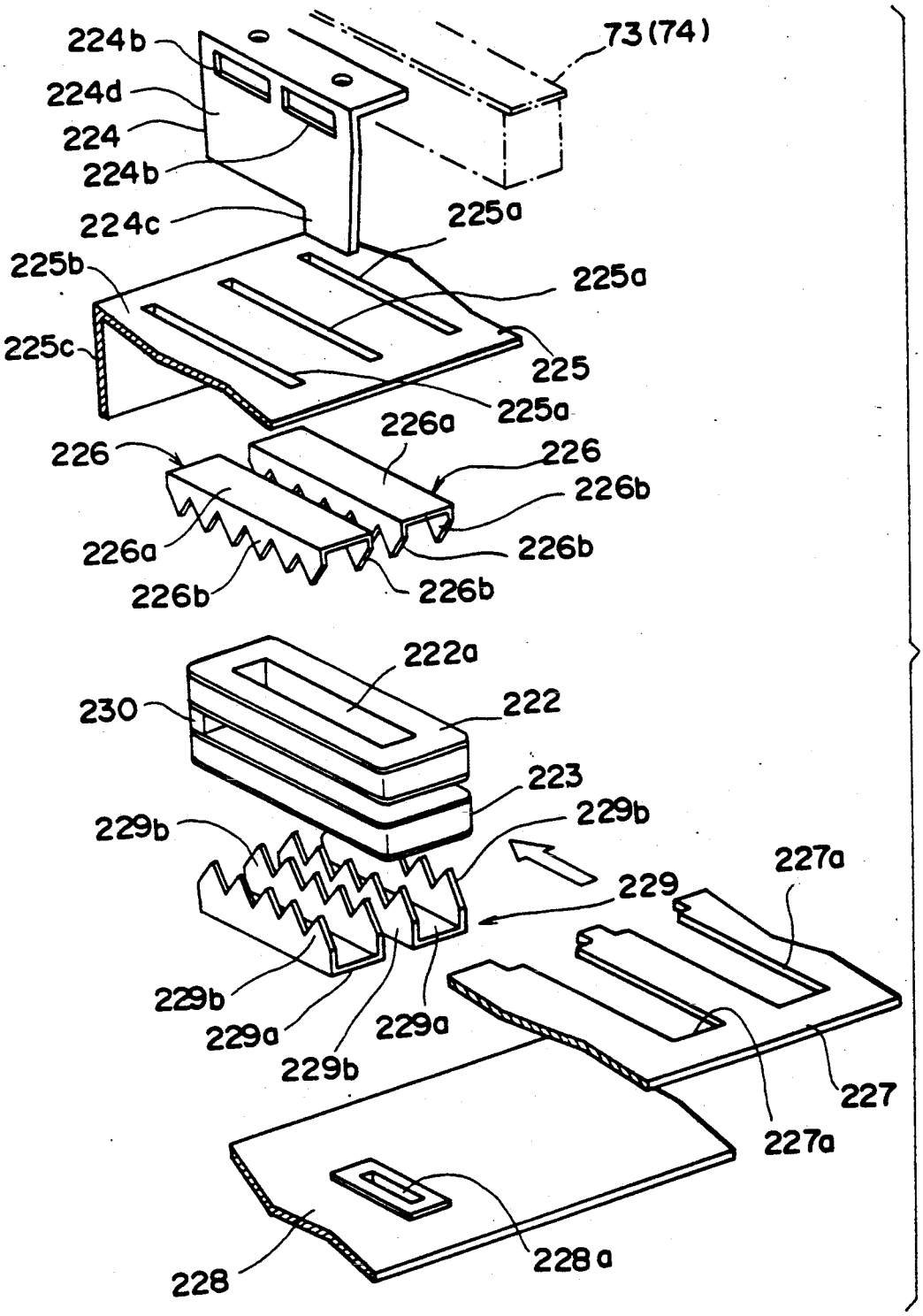
Figure 16:
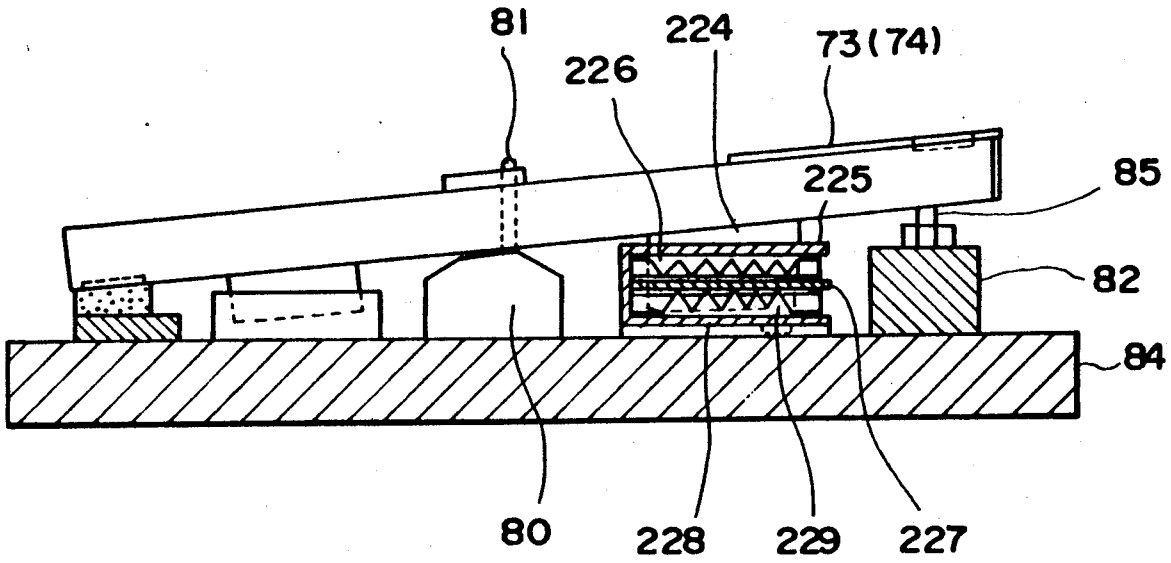

The key actuating device of this embodiment has, as shown in FIG. 15, first and second coils 222 and 223 provided for each key 73 or 74 in a vertical direction and produce magnetic fields in the rocking direction of the key 73 or 74, a plunger 224 fixed on the lower surface of the key 73 or 74 and having a downwardly extending portion 224*d* which is movable in openings of the first and second coils 222 and 223, a top yoke 225 connecting the upper surfaces of the first coils 222 of all keys 73 or 74 commonly and formed with slits 225*a* each having larger width and length than the plunger 224 and enabling the plunger 224 to move therethrough, a pair of top subyokes 226 provided between the top yoke 225 and the first coil 222 and each having a configuration such that a relative area of portions of the top subyoke 226 and the plunger 224 opposing each other increases toward the direction of the magnetic field produced by the first coil 222, a center yoke 227 provided between the first and second coils 222 and 223 for connecting the opposing surfaces of the first and second coils 222 and 223 of all keys 73 or 74 commonly and formed with slits 227*a* each having larger width and length than width and length of the plunger 224 and enabling the plunger 224 to move therethrough, a base yoke 228 connecting the lower surfaces of the second coils 223 of all keys 73 or 74 and formed with slits 228*a* each having larger width and length than width and length of the plunger 224 and enabling the plunger 224 to move therethrough and a pair of bottom subyokes 229 provided between the base yoke 228 and the second coil 223 and each having a configuration such that a relative area of portions of the bottom subyoke 229 and the plunger 224 opposing each other increases toward the direction of the magnetic field produced by the second coil 223. The key actuator units are provided, as shown in FIG. 16, between the balance rail 80 and the front rail 82 and nearer to the front rail 82 on the key bed 84 and arranged transversely to the longitudinal direction of the key 73 or 74.

More specifically, the first coil 222 and the second coil 223 are of a rectangular configuration in a plan view and formed in their central portions with vertically arranged openings 222a and 223a which are of a similar configuration in cross section to the plunger 224 and have width and length larger than width and length of the plunger 224. The coils 222 and 223 are connected to each other by a spacer 230 provided between one short side portions of the coils 222 and 223 and made integral with each other on the same axis and with a space therebetween.

Figure 17:
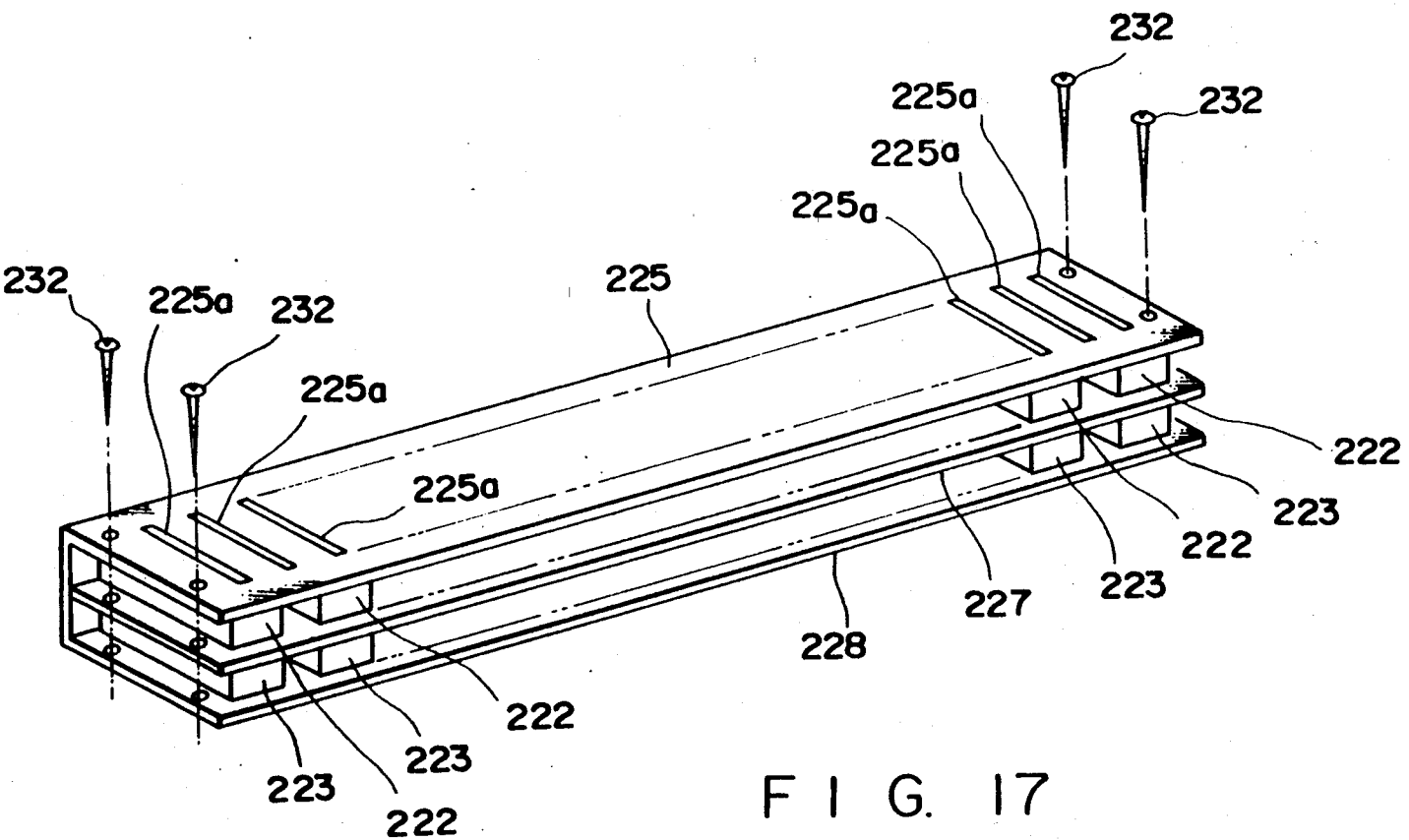

These coils 222 and 223 are provided for each key 73 or 74 in the integrated state and plural sets of the coils 222 and 223 are arranged in parallel (see FIG. 17).

The plunger 224 in this embodiment is formed in a plate-like configuration with its upper end portion bent normally to form a horizontal portion 224a. This horizontal portion 224a is fixed to the lower portion of the key 73 or 74 by means of screws (not shown).

Figure 18:
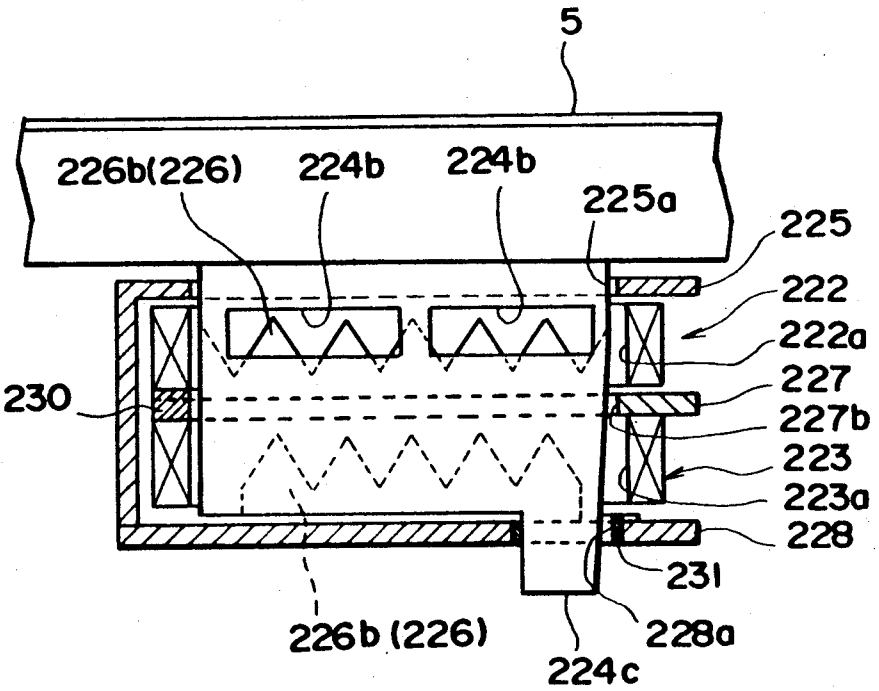

As shown in FIGS. 15 and 18, the plunger 224 is formed with openings 224b in a portion near the lower surface of the key 73 or 74 of the downwardly extending portion 224d so as to reduce the mass of the plunger 224 and thereby improve the key touch of the key 73 or 74 provided with the plunger 224.

As shown in FIGS. 15, 17 and 18, a downwardly projecting tongue portion 224c is integrally formed at the lower end portion of the downwardly extending portion 224d.

The top yoke 225 is formed in a generally L-shape having a horizontal portion 225b and a vertical section 225c. The slits 225a are formed in the horizontal portion 225b in parallel in the number corresponding to the number of keys 73 or 74.

Figure 19:
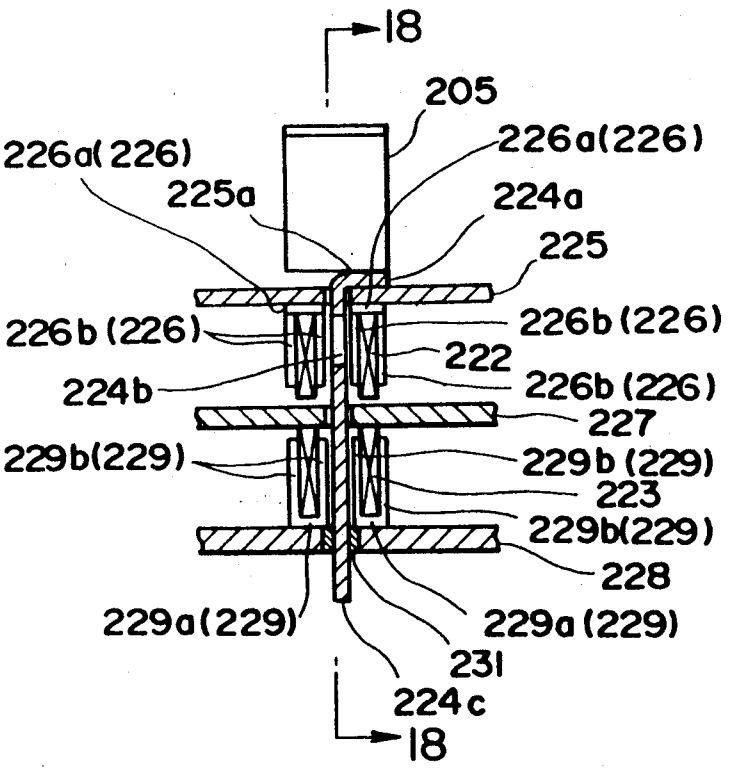

The pair of top subyokes 226 are provided in correspondence to two long side portions of the first coil 222. Each of the top subyokes 226 has, as shown in FIG. 19, an upper horizontal portion 226a interposed between the upper surface of the first coil 222 and the lower surface of the top yoke 225 and two side portions 226b positioned opposite to the outer and inner side surfaces of one of the long side portion of the first coil 222.

The respective side portions 226b of the top subyoke 226 are formed in a saw-tooth portion of an upwardly increasing area.

Assuming that voltage applied to the first coil 222 is constant, thrust F acting on the plunger 224 is given by the following equation (1):

$$F = \frac{10^7}{8\pi} Bg^2 \cdot S \qquad (1)$$

where S represents the area of the portion of the top subyoke 226 opposing the plunger 224 and Bg represents magnetic flux density.

The configuration of the side portions 226b is adopted for obtaining variation in the area in the direction of the magnetic flux which will enable the thrust F to become constant, i.e., which will enable $Bg^2$. S to become constant, when voltage applied to the first coil 222 is constant.

The center yoke 227 has a flat plate-like form as shown in FIGS. 15 and 17. The slits 227a are made slightly smaller than the slits 222a and 223a of the first and second coils 222 and 223 as shown in FIG. 19 and one end portion of these slits 227a is opened so that the spacer 230 can be provided.

The pair of bottom subyokes 229 have a configuration similar to the top subyokes 226 and are mounted on the second coil 224 in such a manner that a lower horizontal portion 229a is disposed under the lower surface of one of the long side portions of the second coil 223 and two side portions 229b are positioned opposite to the outer and inner surfaces of the long side portion of the second coil 223.

The side portions 229b of the bottom subyokes 229 are formed in the saw-tooth portions which are determined by the above equation (1). Since the magnetic field produced by the first coil 222 and the magnetic field produced by the second coil 223 are formed in opposite directions, the saw-teeth of the side portions 229b of the bottom subyokes 229 are determined so that their apex points upward.

The base yoke 228 has a configuration which is substantially the same as the horizontal portion 225b of the top yoke 225 and a plunger guide 231 for inserting the tongue portion 224c of the plunger 224 therethrough is mounted in the slit 228a of the base yoke 228.

For assembling the coils 222 and 223 and the yokes 225, 226, 227, 228 and 229, the top subyokes 226 are mounted on the long side portions of the first coil 222 from above and the bottom subyokes 229 are mounted on the long side portions of the second coil 223 from below. Then, plural sets of these coils 222 and 223 are inserted between the top yoke 225 and the base yoke 228 with the slits 222a and 223a being alligned with the slits 225a and 228a of these yokes 225 and 228. The center yoke 227 is inserted in a space between the coils 222 and 223 and then, as shown in FIG. 17, the top yoke 225, center yoke 227 and the base yoke 228 are connected together by bolts 232, so that these yokes 225, 226, 227, 228 and 229 and the coils 222 and 223 are made integral.

These assembled yokes 225, 226, 227, 228 and 229 and the coils 222 and 223 are mounted between the balance rail 80 and the the front rail 82 and the plungers 224 fixed to the keys 73 or 74 are inserted through the slits 225a, 222a, 227a, 223a and 228a of these yokes and coils. Thus, the key actuating device has been assembled.

In the sixth embodiment of the key actuating device constructed in the above manner, voltage is applied to the first coil 222 and the second coil 223 so as to produce magnetic fields of directions opposite to each other (this can be achieved by winding coils in opposite directions). By controlling thrusts imparted to the plunger 224 by the coils 222 and 223, the direction and speed of movement of the plunger 224 are controlled.

The thrust imparted to the plunger 224 is transmitted directly to the key 73 or 74 through the plunger 224 to actuate the key 73 or 74 and, during actuation of the key 73 or 74, the movable portion including the key 73 or 74 moves integrally, so that there is no member which abuts against or slides along another member in this construction with a result that generation of noise is restrained and reliability and durability of the device are improved.

Besides, since a magnetic path is formed by arranging the top yoke 225, the top subyokes 226 and the center yoke 227 about the first coil 222 and another magnetic path is formed by arranging the center yoke 227, the bottom subyokes 229 and the base yoke 228 about the second coil 223, a component force which pushes up the key 73 or 74 is generated in the first coil 222 and a component force which pushes down the key 73 or 74 is generated in the second coil 223 and, as a result, the absolute value of thrust increases and a flat key thrust characteristic is obtained regardless of the moving stroke of the plunger 224.

Since actuation of the key 73 or 74 can be made by adjusting the degree of balance between thrusts of the two coils 222 and 223 and, moreover, the mass of the plunger 224 is reduced by forming of the openings 224b in the plunger 224, actuation of the key 73 or 74 can be controlled with high accuracy regardless of the position of the key 73 or 74, so that a weak key striking can be reproduced with high fidelity and the repeated key striking characteristic can be improved. Moreover, power consumption can be reduced.

Since the position and movement of the key 73 or 74 is controlled during actuation of the key 73 or 74, an excellent control characteristic can be obtained in performing the feedback control.

Since this embodiment is provided between the balance rail 80 and the front rail 82, the size of the keys 73 or 74 in the transverse direction can be standardized as in the previously described embodiments, so that the pitch of arranging the coils 222 and 223 becomes constant whereby the key actuating device can be applied to variety of pianos.

What is claimed is:

1. A key actuating device of an automatic playing keyboard instrument having a plurality of key actuator units, each key actuator unit being provided for each of keys arranged above a key bed and comprising:

coil means provided above the upper surface of the key bed for producing a magnetic field corresponding to a current supplied from outside and passing therethrough in a direction substantially normal to a rocking direction of the key, the coil means comprising a pair of coils;

a plunger fixedly provided on the lower surface of the key; and yoke means provided fixedly on the coil means and opposing the plunger, the yoke means comprising a pair of yokes corresponding to the pair of coils, a relative area of portions of the yoke means and the plunger opposing each other or an interval between these portions being variable in the rocking direction of the key and the plunger being not in contact with the coil means or the yoke means at any position of the plunger in the rocking movement of the key, and a relative area of portions of one of the pair of yokes and the plunger opposing each other or an interval therebetween varies in opposite direction to a relative area of portions of the other of the pair of yokes and the plunger opposing each other or an interval therebetween.

2. A key actuating device as defined in claim 1 wherein the pair of coils and the pair of yokes are arranged in the longitudinal direction of the key with an interval between the respective coils and the respective yokes.

3. A key actuating device as defined in claim 2 wherein each of the yokes has an upwardly opening space formed therein, and the plunger has a vertically extending portion being movable in the upwardly opening space formed in each yoke and having at least a row of windows which are arranged vertically and oppose one of the pair of yokes and whose area progressively increases or decreases and having at least another row of windows which are arranged vertically and oppose the other of the pair of yokes and whose area progressively increases or decreases in inverse relation to the row of windows which oppose said one of the pair of yokes.

4. A key actuating device as defined in claim 2 wherein each of the yokes has an upwardly opening space formed therein, and the plunger has a vertically extending portion of a substantially parallelogram configuration with its opposing end surfaces in the longitudinal direction of the key being inclined in substantially the same direction and being movable in the upwardly opening space formed in the respective yokes.

5. A key actuating device as defined in claim 2 wherein each of the yokes has an upwardly opening space formed therein, and the plunger has a vertically extending portion having two triangular windows one of which is formed with its one apex pointing downwardly and the other of which is formed with its apex pointing upwardly and being movable in the upwardly opening space formed in the respective yokes.

6. A key actuating device as defined in claim 2 wherein each of the yokes has an upwardly opening space formed therein, and the plunger has a first vertically extending portion having a wedge-like section with its thickness increasing progressively downwardly and being movable in the upwardly opening space formed in one of the pair of yokes and a second vertically extending portion having a wedge-like section with its thickness decreasing progressively downwardly and being movable in the upwardly opening space formed in the other of the pair of yokes.

7. A key actuating device as defined in claim 2 wherein the plunger has an obliquely downwardly extending portion having inclined end surfaces in the longitudinal direction of the key and being movable in the interval between the pair of yokes which respectively have opposing end surfaces which are inclined in the same direction as the end surfaces of the obliquely downwardly extending portion of the plunger.

8. A key actuating device as defined in claim 7 wherein the plunger is made of an oblong ferromagnetic plate member bent in two portions, one of the two portions constituting the obliquely downwardly extending portion and the other of the two portions constituting a portion at which the plunger is fixed on the lower surface of the key.

9. A key actuating device as defined in claim 1 wherein the pair of coils are arranged adjacent to each other transversely to the longitudinal direction of the key.

10. A key actuating device as defined in claim 9 wherein the pair of yokes are arranged adjacent to each other transversely to the longitudinal direction of the key, each of the yokes has an upwardly opening space formed therein, and the plunger has a vertically extending portion having a pair of triangular plate portions with their one end surfaces in the longitudinal direction of the key being inclined in opposite directions to each other and said said vertically extending portion is movable in the upwardly opening space formed in the respective yokes.

11. A key actuating device of an automatic playing keyboard instrument having a plurality of key actuator units, each key actuator unit being provided for each of keys arranged above a key bed and comprising:

coil means provided above the upper surface of the key bed for producing a magnetic field corresponding to a current supplied from outside and passing therethrough in a direction substantially normal to a rocking direction of the key;

a plunger fixedly provided on the lower surface of the key, the plunger having a pair of downwardly extending portions arranged transversely to the longitudinal direction of the key thereby forming a downwardly opening space therebetween; and yoke means provided fixedly on the coil means and opposing the plunger, the yoke means having a pair of upwardly extending portions arranged transversely to the longitudinal direction of the key thereby forming an upwardly opening space therebetween, a relative area of portions of the yoke means and the plunger opposing each other or an interval between these portions being variable in the rocking direction of the key, the plunger being movable in the upwardly opening space of the yoke means and the plunger being not in contact with the coil means or the yoke means at any position of the plunger in the rocking movement of the key.

12. A key actuating device as defined in claim 11 wherein the upwardly extending portions of the yoke means are formed with taper portions of upwardly decreasing thickness.

13. A key actuating device as defined in claim 12 wherein the plunger is made of a single member and the downwardly extending portions of the plunger are tapered with a downwardly decreasing thickness in conformity with the taper portions of the upwardly extending portions of the yoke.

14. A key actuating device as defined in claim 13 wherein spring means is provided between the plunger and the coil means.

15. A key actuating device as defined in claim 11 wherein the upwardly extending portions of the yoke means are formed with saw-tooth portions and the downwardly extending portions of the plunger are formed with corresponding saw-tooth portions.

16. A key actuating device as defined in claim 15 wherein the number of inclined surfaces of the saw-tooth portions is an odd number.

17. A key actuating device as defined in claim 15 wherein the yoke means comprises a common yoke plate to which the upwardly extending portions of the yokes of the plurality of key actuator units are fixed and each of the upwardly extending portions opposes two adjacent downwardly extending portions of the plungers of two adjacent key actuator units.

18. A key actuating device of an automatic playing keyboard instrument having a plurality of key actuator units, each key actuator unit being provided for each of keys arranged above a key bed and comprising:

coil means provided above the upper surface of the key bed for producing a magnetic field corresponding to a current supplied from outside and passing therethrough in a direction substantially normal to a rocking direction of the key;

a plunger fixedly provided on the lower surface of the key; and yoke means provided fixedly on the coil means and opposing the plunger, a relative area of portions of the yoke means and the plunger opposing each other or an interval between these portions being variable in the rocking direction of the key and the plunger being not in contact with the coil means or the yoke means at any position of the plunger in the rocking movement of the key, and wherein the coil means comprises a first coil and a second coil arranged in the vertical direction for producing magnetic fields along the direction of the rocking movement of the key and respectively having an opening of width and length larger than width and length of the plunger, the plunger is movable in the openings of the first and second coils, and the yoke means comprises a top yoke connecting the upper surfaces of the first coils of all keys commonly and formed with slits each having larger width and length than the plunger and enabling the plunger to move therethrough, a pair of top subyokes provided between the top yoke and the first coil and each having a configuration such that a relative area of portions of the top subyoke and the plunger opposing each other increases toward the direction of the magnetic field produced by the first coil, a center yoke provided between the first and second coils for connecting the opposing surfaces of the first and second coils of all keys commonly and formed with slits each having larger width and length than width and length of the plunger and enabling the plunger to move therethrough, a base yoke connecting the lower surfaces of the second coils of all keys commonly and formed with slits each having larger width and length than width and length of the plunger and enabling the plunger to move therethrough and a pair of bottom subyokes provided between the base yoke and the second coil and each having a configuration such that a relative area of portions of the bottom subyoke and the plunger opposing each other increases toward the direction of the magnetic field produced by the second coil.

19. A key actuating device as defined in claim 18 wherein the direction of the magnetic field produced by the first coil is opposite to the direction of the magnetic field produced by the second coil and an actuating force corresponding to difference in strength between the two magnetic fields is imparted to the plunger.

20. A key actuating device of an automatic playing keyboard instrument having a plurality of key actuator units, each key actuator unit being provided for each of keys arranged above a key bed and comprising:

a pair of coils provided above the upper surface of the key bed for generating a magnetic field corresponding to a current supplied from outside and passing therethrough in a direction substantially normal to a rocking direction of the key, the coils being provided between a balance rail provided on the key bed and rockably supporting the key and a front rail provided on the key bed and being capable of engaging a front end portion of the key;

a pair of yokes fixedly provided above the coils; and a plunger fixedly provided on the lower surface of the key and opposing the yokes, a relative area of portions of the yokes and the plunger opposing each other or an interval between these portions being variable in the rocking direction of the key and the plunger being not in contact with the coils or the yokes at any position of the plunger in the rocking movement of the key, and relative areas of portions of the plunger and each of the pair of yokes opposing each other or intervals between these portions varying in inverse relation to each other, and being suspended in the magnetic field produced by the pair of coils and the yokes.

21. A key actuating device as defined in claim 20 wherein the pair of coils are arranged adjacent to each other transversely to the longitudinal direction of the key.

22. A key actuating device as defined in claim 20 wherein the pair of coils are arranged in the longitudinal direction of the key with an interval therebetween and the plunger is movable in the interval between the coils.

23. A key actuating device as defined in claim 1 wherein the first coil and the second coil are arranged in the vertical direction for producing magnetic fields in the direction of the rocking movement of the key and respectively have an opening of width and length larger than width and length of the plunger, the plunger being movable in the openings of the first and second coils, the yokes comprising:

a top yoke connecting the upper surfaces of the first coils of all keys commonly and formed with slits each having larger width and length than the plunger and enabling the plunger to move therethrough, a pair of top subyokes provided between the top yoke and the first coil and each having a configuration such that a relative area of portions of the top subyoke and the plunger opposing each other increases toward the direction of the magnetic field produced by the first coil, a center yoke provided between the first and second coils for connecting the opposing surfaces of the first and second coils of all keys commonly and formed with slits each having larger width and length than width and length of the plunger and enabling the plunger to move therethrough, a base yoke connecting the lower surfaces of the second coils of all keys commonly and formed with slits each having larger width and length than width and length of the plunger and enabling the plunger to move therethrough, and a pair of bottom subyokes provided between the base yoke and the second coil and each having a configuration such that a relative area of portions of the bottom subyoke and the plunger opposing each other increases toward the direction of the magnetic field produced by the second coil.

24. A key actuating device as defined in claim 23 wherein the plunger is formed with an aperture in a portion in the vicinity of the lower surface of the key.

25. A key actuating device as defined in claim 23 wherein the direction of the magnetic field produced by the first coil is opposite to the direction of the magnetic field produced by the second coil and an actuating force corresponding to difference in strength between the two magnetic fields is imparted to the plunger.

* * * * *